US011939759B2

(12) United States Patent
Oda

(10) Patent No.: US 11,939,759 B2
(45) Date of Patent: Mar. 26, 2024

(54) SEWAGE SYSTEM

(71) Applicant: Shuhei Oda, Tokyo (JP)

(72) Inventor: Shuhei Oda, Tokyo (JP)

( * ) Notice: Subject to any disclaimer, the term of this patent is extended or adjusted under 35 U.S.C. 154(b) by 168 days.

(21) Appl. No.: 17/595,286

(22) PCT Filed: May 29, 2020

(86) PCT No.: PCT/JP2020/021488
§ 371 (c)(1),
(2) Date: Nov. 12, 2021

(87) PCT Pub. No.: WO2020/241889
PCT Pub. Date: Dec. 3, 2020

(65) Prior Publication Data

US 2022/0213676 A1 Jul. 7, 2022

(30) Foreign Application Priority Data

May 30, 2019 (JP) ..... 2019-101834

(51) Int. Cl.
*E03F 1/00* (2006.01)
*E03F 3/04* (2006.01)
*E03F 5/10* (2006.01)

(52) U.S. Cl.
CPC ..... *E03F 1/00* (2013.01); *E03F 5/10* (2013.01); *E03F 3/04* (2013.01)

(58) Field of Classification Search
CPC ..... E03F 1/00; E03F 5/10; E03F 3/04; E03F 3/02; E03F 5/106; E03F 1/001; C02F 1/00
USPC ..... 210/170.03
See application file for complete search history.

(56) References Cited

U.S. PATENT DOCUMENTS 8,343,340 B2 * 1/2013 Oda ..... E03F 5/12 210/170.03

FOREIGN PATENT DOCUMENTS

| | | | |
|---|---|---|---|
| JP | 3176315 | B2 | 6/2001 |
| JP | 2006161554 | A | 6/2006 |
| JP | 2010216070 | A | 9/2010 |
| JP | 2016204832 | A | 12/2016 |

OTHER PUBLICATIONS

International Search Report issued by the International Search Authority in corresponding International Application No. PCT/JP2020/021488, dated Aug. 25, 2020.

* cited by examiner

*Primary Examiner* — Ekandra S. Miller-Cruz
(74) *Attorney, Agent, or Firm* — ArentFox Schiff LLP

(57) ABSTRACT

Sewage flowing into a second water branching device is accurately controlled to separate into the following: sewage with a maximum sewage volume that can be discharged into a public water body W, the sewage sequentially passing through a first regulating tank, a first orifice, a second regulating tank, a second orifice, a third regulating tank and a third orifice to flow into a second discharge pipe; and sewage with an excess sewage volume, the sewage overflowing first to third overflow weirs to flow into an inflow pipe for a regulating reservoir.

16 Claims, 19 Drawing Sheets

SEWAGE SYSTEM

CROSS REFERENCE TO RELATED APPLICATIONS

This application is a U.S. National Stage Entry of PCT International Application No. PCT/JP2020/021488, filed May 29, 2020, which claims priority to Japanese Patent Application No. 2019-101834, filed May 30, 2020. The content of each of the prior applications are hereby incorporated in their entireties by reference.

TECHNICAL FIELD

The present disclosure relates to a sewage system including a water branching device.

BACKGROUND ART

Sewage systems include a combined sewage system that drains, through the same channel, rainwater from a rainfall and wastewater such as domestic wastewater, and a separated sewage system that drains rainwater and wastewater through separate channels.

For a combined sewage system, under a rainfall, rainwater and wastewater (hereinafter "rainwater and wastewater" are also referred to as "sewage") are drained into a confluence pipe. For a combined sewage system, when rainwater exceeding a predetermined volume has flowed into a confluence pipe, sewage is separated, in a rainwater discharge chamber, into sewage to be drained into a sewage treatment plant via an intercepting pipe and sewage to be discharged to a river or the like via a discharge pipe. In a separated sewage system, a rainwater pipe and a wastewater pipe are separately provided, and under a rainfall, rainwater is drained into a rainwater pipe and discharged into a river or the like, and wastewater is drained into a wastewater pipe and discharged into a sewage treatment plant.

Under a heavy rainfall, sewage discharged from a discharge pipe in a combined sewage system, or rainwater discharged from a rainwater pipe in a separated sewage system increases in volume, and thus a river or the like could be flooded. In consideration of this risk, a combined sewage system or a separated sewage system may include a regulating reservoir. By temporarily storing, in a regulating reservoir, a predetermined volume of sewage coming into a discharge pipe in a combined sewage system, or a predetermined volume of rainwater coming into a rainwater pipe in a separated sewage system, it is possible to prevent flooding of a river or the like.

Generally speaking, a regulating reservoir includes an orifice as an outlet and a discharge volume from a regulating reservoir into a river or the like is regulated so as not to exceed a tolerable volume. A technique is disclosed in Patent Literature 1 whereby an on-off valve to select any one of three ratios of valve opening, depending on a rainfall volume or the like, is provided at an outlet of a regulating reservoir to regulate a discharge volume from the regulating reservoir.

CITATION LIST

Patent Literature

Patent Literature 1: Japanese Patent No. 3176315

SUMMARY OF INVENTION

Technical Problem

There is, however, a problem that, it is difficult, for a regulating reservoir of a sewage system disclosed in Patent Literature 1 or the like, to efficiently regulate a discharge volume via an orifice provided as an outlet or an on-off valve provided at an outlet, thus increasing a capacity requirement of a regulating reservoir.

The disclosure has been provided in consideration of the aforementioned circumstances and aims to provide a sewage system capable of reducing a capacity requirement of a regulating reservoir.

Solution to Problem

In order to attain the above object, the sewage system of the disclosure is a sewage system including:

a first water branching device to which are connected a confluence pipe that introduces sewage, an intercepting pipe that drains sewage into a sewage treatment plant and a first discharge pipe, the first water branching device separating sewage coming from the confluence pipe into sewage to be drained into the intercepting pipe and sewage to be drained into the first discharge pipe; and a second water branching device to which are connected the first discharge pipe, a second discharge pipe that discharges sewage into a public water body and an inflow pipe for a regulating reservoir, the inflow pipe being connected to a regulating reservoir that stores sewage, the second water branching device separating sewage coming from the first discharge pipe into sewage to be drained into the second discharge pipe and sewage to be drained into the inflow pipe for a regulating reservoir, wherein the second water branching device includes a channel in which sewage coming from the first discharge pipe is drained into the second discharge pipe, a plurality of overflow weirs erected on at least one of both sides of the channel, a plurality of partitions each provided between each of the plurality of overflow weirs and between one of the overflow weirs and the second discharge pipe, the plurality of partitions each including an orifice formed therein, and a plurality of regulating tanks demarcated by the plurality of overflow weirs and the plurality of partitions, and the inflow pipe for a regulating reservoir introducing sewage overflowing the plurality of overflow weirs is connected below the plurality of regulating tanks.

Advantageous Effects of Invention

According to the disclosure, it is possible to provide a sewage system capable of reducing a capacity requirement of a regulating reservoir.

DESCRIPTION OF EMBODIMENTS

A sewage system according to embodiments of the disclosure is described below with reference to drawings.

Embodiment 1

A sewage system according to Embodiment 1 is described below with reference to FIG. 1, FIGS. 2A to 2C, FIGS. 3A to 3C, FIGS. 4A to 4C, and FIGS. 5A to 5C. The sewage system according to Embodiment 1 is a combined sewage system that drains rainwater from a rainfall and wastewater such as domestic wastewater through the same confluence pipe. FIGS. 2A, 3A, 4A and 5A are each a partial cross-sectional view of a pipe alone of a water branching device without a lid.

Figure 1:
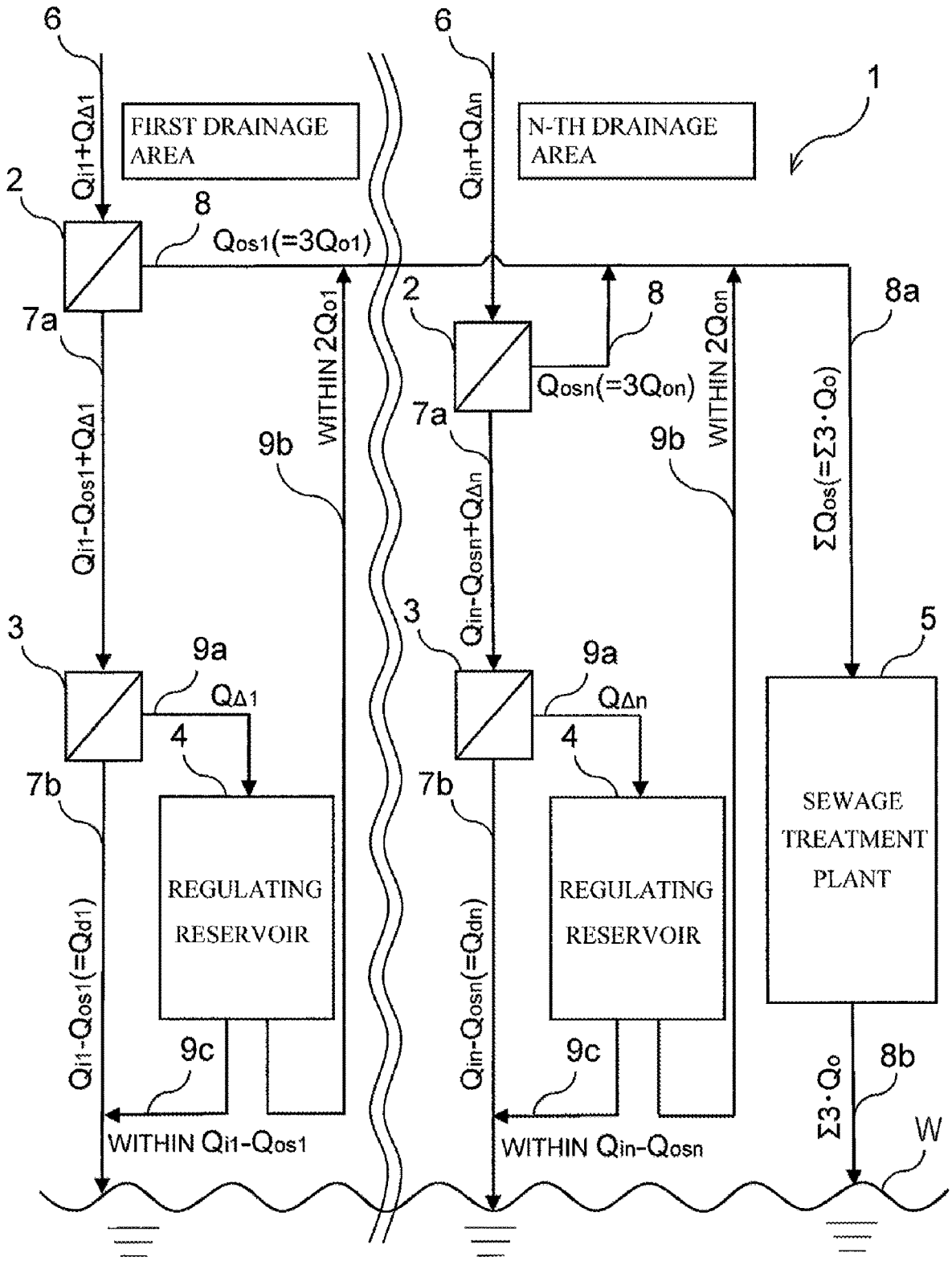
FIG. 1 is a block diagram illustrating a configuration of a combined sewage system according to Embodiment 1 of the disclosure.
Figure 2A:
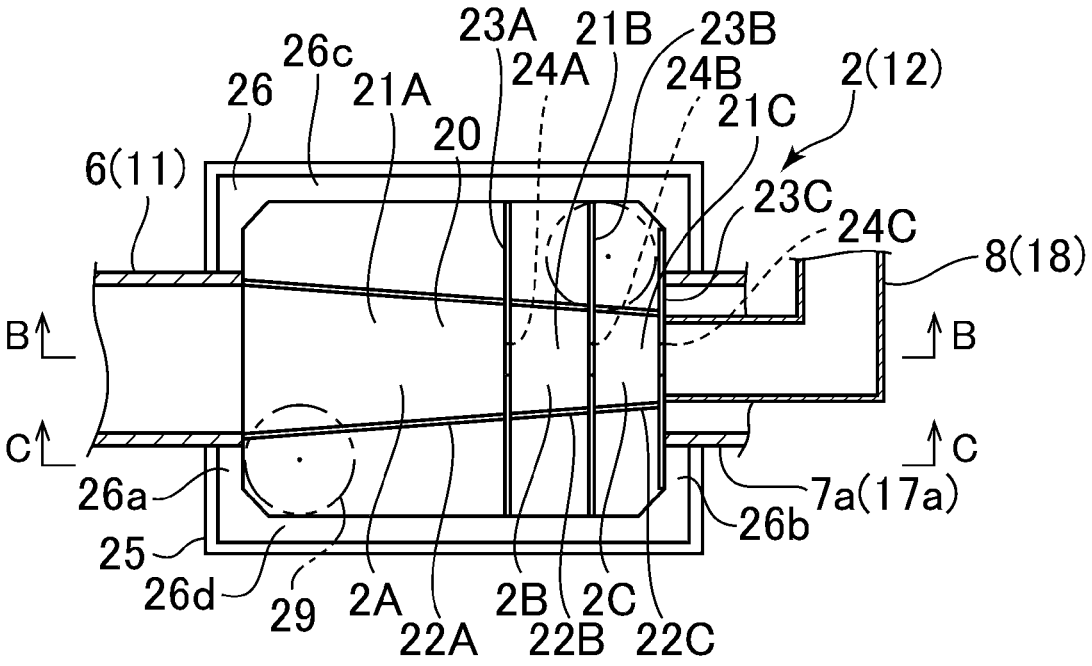
FIG. 2A is a partial cross-sectional plan view illustrating a configuration of a first water branching device included in a sewage system according to Embodiment 1 and Embodiment 2.
Figure 2B:
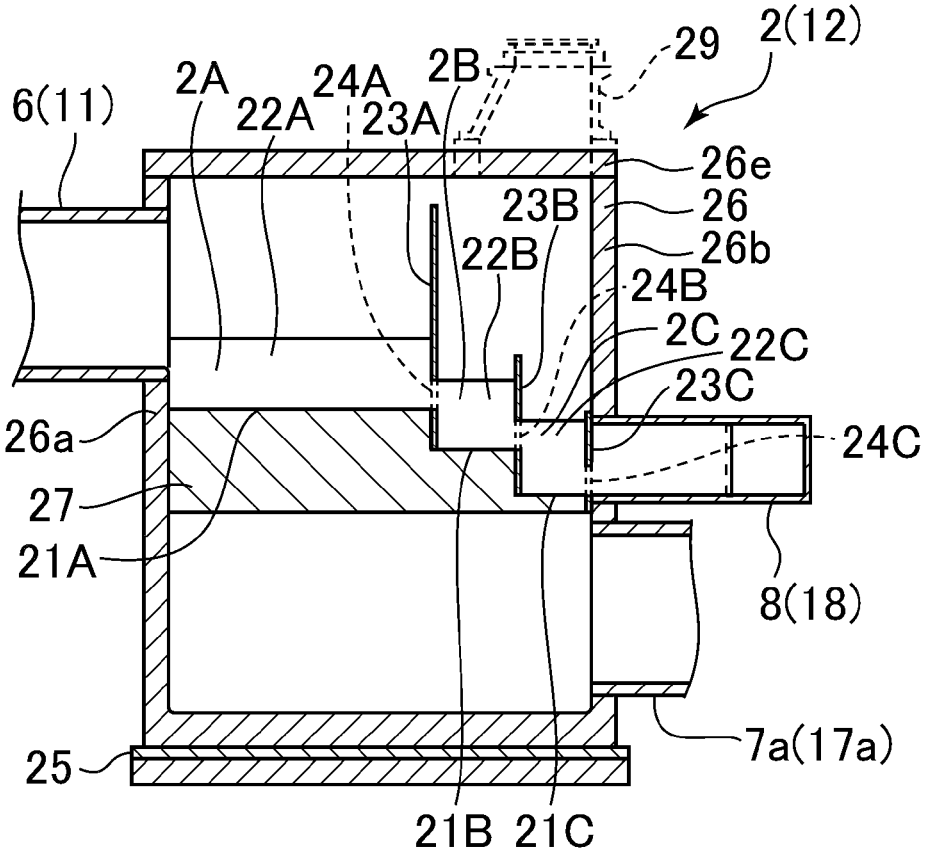
FIG. 2B is a cross-sectional view taken along line B-B of FIG. 2A.
Figure 2C:
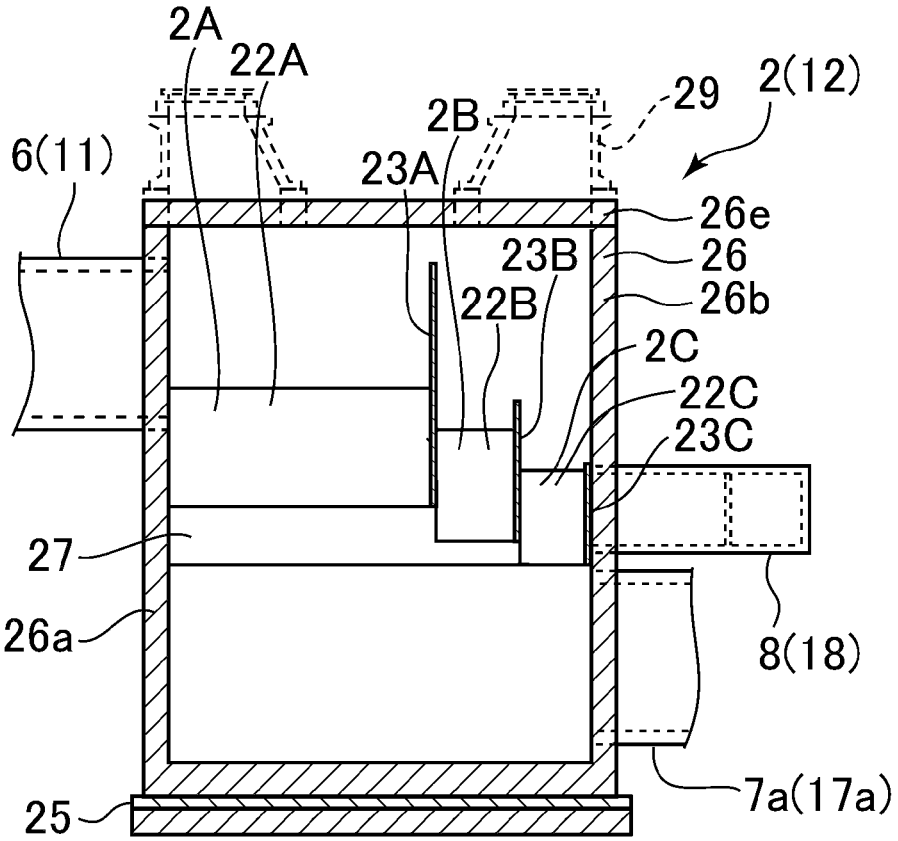
FIG. 2C is a cross-sectional view taken along line C-C of FIG. 2A.

As illustrated in FIG. 1, a combined sewage system 1 includes, in each of first to nth drainage areas, n being a natural number, hereinafter also referred to as "each drainage area", a first water branching device 2, a second water branching device 3, and a regulating reservoir 4, and the combined sewage system 1 also includes a sewage treatment plant 5 in charge of sewage treatment of all drainage areas. The combined sewage system 1 includes, in each drainage area, a confluence pipe 6 that introduces rainwater and wastewater (sewage) under a rainfall and drains the introduced sewage into the first water branching device 2, a first discharge pipe 7*a* that drains one part of sewage separated by the first water branching device 2 into the second water branching device 3, an intercepting pipe 8 that drains the other part of sewage separated by the first water branching device 2 into the sewage treatment plant 5, a second discharge pipe 7*b* that discharges one part of sewage separated by the second water branching device 3 into a public water body W such as a river, and an inflow pipe 9*a* for a regulating reservoir that drains the other part of sewage separated by the second water branching device 3 into the regulating reservoir 4.

The combined sewage system 1 includes, in each drainage area, an outflow pipe 9*b* for a regulating reservoir that drains sewage coming from the regulating reservoir 4 into the sewage treatment plant 5 after a rainfall and a discharge pipe 9*c* for a regulating reservoir that discharges sewage coming from the regulating reservoir 4 into the public water body W after a rainfall. The combined sewage system 1 includes an inflow pipe 8*a* for a sewage treatment plant, to which the intercepting pipe 8 of each drainage area is connected, the inflow pipe 8*a* for a sewage treatment plant introducing all of the other part of sewage separated by the first water branching device 2 and draining the introduced sewage into the sewage treatment plant 5 and a discharge pipe 8*b* for a sewage treatment plant that discharges purified sewage coming from the sewage treatment plant 5 into the public water body W.

The first water branching device 2 is a unit capable of highly accurately separating sewage coming from the confluence pipe 6 into the following: sewage with a desired sewage volume to be drained into the sewage treatment plant 5 via the intercepting pipe 8 and the inflow pipe 8*a* for a sewage treatment plant; and sewage to be drained into the second water branching device 3 via the first discharge pipe 7*a*. The first water branching device 2 includes, as illustrated in FIGS. 2A to 2C and FIGS. 3A to 3C, three regulating tanks, that is, first to third regulating tanks 2A, 2B, 2C inside a housing 26 erected with a lid 26*e* thereof closed on a base board 25. The first regulating tank 2A is arranged upstream, the third regulating tank 2C is arranged downstream, and the second regulating tank 2B is arranged in the middle of the first regulating tank 2A and the third regulating tank 2C. The first to third regulating tanks 2A, 2B, 2C are provided in a row.

The confluence pipe 6 is connected to a side wall 26*a* upstream of the housing 26 and sewage flows from the confluence pipe 6 into the first regulating tank 2A. The intercepting pipe 8 is connected to a side wall 26*b* arranged downstream opposed to the side wall 26*a* upstream of the housing 26 and sewage flows from the third regulating tank 2C into the intercepting pipe 8. In other words, a channel 20 is configured in which sewage coming from the confluence pipe 6 flows into the intercepting pipe 8. Below the intercepting pipe 8 on the side wall 26*b* downstream of the housing 26 is connected the first discharge pipe 7*a*. The first discharge pipe 7*a* is connected to the center of a lower part of the side wall 26*b* and arranged below the first to third regulating tanks 2A, 2B, 2C. While the intercepting pipe 8 is curved in an L shape to allow connection to the inflow pipe 8*a* for a sewage treatment plant, a shape or the like of the intercepting pipe 8 may undergo modifications as appropriate depending on an arrangement plan of each facility or the like.

The first to third regulating tanks 2A, 2B, 2C are provided on abase 27. The base 27 is constructed between the side wall 26*a* and the side wall 26*b* of the housing 26. An upper surface of the base 27 is formed into stairs descending from upstream to downstream and constitutes first to third bottoms 21A, 21B, 21C of the first to third regulating tanks 2A, 2B, 2C. In other words, the first to third bottoms 21A, 21B, 21C are formed to become gradually lower from upstream to downstream. The first bottom 21A is formed longer than the second bottom 21B and the third bottom 21C in a direction of a channel. The planar first to third bottoms 21A, 21B, 21C are formed with ends in a longitudinal direction inclined inward so that a width in a lateral direction will become narrower from upstream to downstream. The ends of the first to third bottoms 21A, 21B, 21C are formed in a longitudinal direction while inclined inward because, for example, the diameter of the intercepting pipe 8 arranged downstream is smaller than that of the confluence pipe 6 arranged upstream.

On both sides of the first bottom 21A of the first regulating tank 2A are erected, opposed to each other, a pair of first overflow weirs 22A along a direction of a channel. On both sides of the second bottom 21B of the second regulating tank 2B are erected, opposed to each other, a pair of second overflow weirs 22B along a direction of a channel. On both sides of the third bottom 21C of the third regulating tank 2C are erected, opposed to each other, a pair of third overflow weirs 22C along a direction of a channel. The first to third overflow weirs 22A, 22B, 22C are provided on both sides of the channel 20, so that sewage overflowing the first to third overflow weirs 22A, 22B, 22C flows down from both sides of the channel 20.

A height of the first overflow weir 22A arranged upstream is set in accordance with a water level of sewage with a pre-planned interception volume $Q_{osn}$ described later that has flowed into the confluence pipe 6. When a height of the first overflow weir 22A is set higher than the water level of sewage with the pre-planned interception volume $Q_{osn}$ that has flowed into the confluence pipe 6, a backwater effect is triggered inside the confluence pipe 6, resulting in a decrease in a downward flow capacity in the confluence pipe 6 or retention or sedimentation of a pollution load in the confluence pipe 6. A height of the third overflow weir 22C arranged downstream is set higher than a water level of sewage overflowing the first to third overflow weirs 22A, 22B, 22C to flow down into housing 26.

Between the first regulating tank 2A and the second regulating tank 2B, that is, between the first overflow weir 22A and the second overflow weir 22B, is erected a first plate-shaped partition 23A in a direction orthogonal to a direction of a channel. Between the second regulating tank 2B and the third regulating tank 2C, that is, between the second overflow weir 22B and the third overflow weir 22C, is erected a second plate-shaped partition 23B in a direction orthogonal to a direction of a channel. Between the third regulating tank 2C and the intercepting pipe 8, that is, between the third overflow weir 22C and intercepting pipe 8, is erected a third plate-shaped partition 23C in a direction orthogonal to a direction of a channel. Accordingly, the first to third regulating tanks 2A, 2B, 2C are demarcated by the first to third overflow weirs 22A, 22B, 22C and the first to third partitions 23A, 23B, 23C.

The first partition 23A and the second partition 23B is extendedly constructed between a side wall 26*c* and a side wall 26*d* of the housing 26. The first partition 23A and the second partition 23B are constructed between the side wall 26*c* and the side wall 26*d*, which avoids an influence of waves caused when sewage overflowing the first overflow weir 22A and the second overflow weir 22B falls into the third regulating tank 2C. The third partition 23C is provided in contact with the side wall 26*b* downstream of the housing 26.

The first to third partition 23A, 23B, 23C have first to third orifices 24A, 24B, 24C formed thereon, the orifices being opened. The first to third orifices 24A, 24B, 24C each are formed with their lowermost part positioned at a height of the first to third bottoms 21A, 21B, 21C. The first to third orifices 24A, 24B, 24C each are a submerged orifice arranged entirely lower than a water surface downstream. The first to third orifices 24A, 24B, 24C each are formed into a submerged orifice, which eliminates a need for considering a vertical velocity distribution at an outlet or whether an opening size is large or small, despite a shallow opening position, thereby stabilizing a water surface in the first to third regulating tanks 2A, 2B, 2C.

On the lid 26*e* of the housing 26 is provided a control/inspection part 29. The control/inspection part 29 includes an inspection hole formed therein, which allows inspection of the housing interior from outside the housing 26.

The second water branching device 3 is a unit capable of accurately separating sewage separated by the first water branching device 2 and coming from the first discharge pipe 7*a*, into the following: sewage with a desired sewage volume to be discharged into the public water body W via the second discharge pipe 7*b*; and sewage with a desired sewage volume to be drained into the regulating reservoir 4 via the inflow pipe 9*a* for a regulating reservoir. For the second water branching device 3, as illustrated in FIGS. 4A to 4C and FIGS. 5A to 5C, the same sign is given to the same component as that of the first water branching device 2 and a description thereof is omitted.

The second water branching device 3 includes the first discharge pipe 7*a* connected to the side wall 26*a* upstream of the housing 26, and sewage flows from the first discharge pipe 7*a* into the first regulating tank 2A. To the side wall 26*b* arranged downstream opposed to side wall 26*a* upstream of the housing 26 is connected the second discharge pipe 7*b* and sewage flows from the third regulating tank 2C into the second discharge pipe 7*b*. In other words, the channel 20 is configured in which sewage coming from the first discharge pipe 7*a* flows into the second discharge pipe 7*b*. To the side wall 26*c* orthogonal to the side walls 26*a*, 26*b* of the housing 26 is connected the inflow pipe 9*a* for a regulating reservoir. The inflow pipe 9*a* for a regulating reservoir is connected to the center of the lower part of the side wall 26*c* and arranged below the first to third regulating tanks 2A, 2B, 2C.

The first to third regulating tanks 2A, 2B, 2C are provided on abase 37. The base 37 is different from the base 27 of the first water branching device 2 in that the base 37 is erected on the bottom of the housing 26. The base 37 is also different from the base 27 in that, in the lower part of the base 37 is formed a through hole 37*a* arranged at a position of the inflow pipe 9*a* for a regulating reservoir, the through hole 37*a* having a substantially identical diameter to that of the inflow pipe 9*a* for a regulating reservoir.

In the housing 26, an inclined path 28 is provided below both outer sides of the first to third overflow weirs 22A, 22B, 22C. The inclined path 28 includes a semicircle-shaped recessed part 28*a* arranged at the position of the lower half of the inflow pipe 9*a* for a regulating reservoir, the semicircle-shaped recessed part 28*a* having a substantially identical diameter to an inner diameter of the inflow pipe 9*a* for a regulating reservoir and an inclined surface 28*b* slanted downward toward the semicircle-shaped recessed part 28*a* from the side walls 26*a*, 26*b* of the housing 26, respectively. A height of the third overflow weir 22C arranged downstream is set higher than a water level of sewage that overflowing the first to third overflow weirs 22A, 22B, 22C to flow down into the inclined path 28.

In the second water branching device 3, a height of the first overflow weir 22A of the first regulating tank 2A arranged upstream is set in accordance with a water level of sewage with a sewage volume $Q_{in}-Q_{osn}$ ($=Q_{dn}$) ($Q_{in}$, $Q_{osn}$ and $Q_{dn}$ are described later) that has flowed into the first discharge pipe 7*a*. When a height of the first overflow weir 22A is set higher than the water level of sewage with a sewage volume $Q_{in}-Q_{osn}$ ($=Q_{dn}$) that has flowed into the first discharge pipe 7*a*, a backwater effect is triggered inside the first discharge pipe 7*a*, resulting in a decrease in a downward flow capacity in the first discharge pipe 7*a* or retention or sedimentation of a pollution load in the first discharge pipe 7*a*.

The regulating reservoir 4 is a facility that temporarily stores and regulates sewage separated by the second water branching device 3 in order to prevent possible flooding of a river or the like caused by discharge of sewage into the public water body W under a heavy rainfall. The sewage treatment plant 5 is a facility that purifies and discharges, into the public water body W, the following: sewage separated by the first water branching device 2 and coming from the inflow pipe 8*a* for a sewage treatment plant via the intercepting pipe 8; and sewage with a predetermined volume temporarily stored in the regulating reservoir 4 and coming from the inflow pipe 8*a* for a sewage treatment plant via the outflow pipe 9*b* for a regulating reservoir. The sewage treatment plant 5 performs, for example, a higher treatment in which sewage undergoes a sedimentation treatment, a biological treatment and a disinfection treatment, or a simple treatment in which sewage undergoes only a sedimentation treatment and a disinfection treatment. In a higher treatment, a biological treatment is performed to remove organic substances, nitrogen, phosphorus and the like. Sewage to undergo a simple treatment may be temporarily stored in a storage facility before undergoing a higher treatment.

Next, a method for treating sewage by using the combined sewage system 1, for example, under a heavy rainfall or a downpour, will be described. Assume that, in an nth drainage area, a pre-planned interception volume is defined as $Q_{osn}$, a pre-planned sewage volume is defined as $Q_{in}$, an excess sewage volume is defined as $Q_{\Delta n}$, and a maximum sewage volume that can be discharged into the public water body W without intervention of the sewage treatment plant 5 is defined as $Q_{dn}$ (n is a natural number). The pre-planned interception volume $Q_{osn}$ is set as a maximum sewage volume that undergoes a sewage treatment, as a quota for an nth drainage area, in the sewage treatment plant 5. The pre-planned interception volume $Q_{osn}$ sa is set, for example, to three times a maximum hourly wastewater volume under a fine weather $Q_{on}$, and, in the sewage treatment plant 5, undergoes a higher treatment until a sewage volume reaches $Q_{on}$, for example. An excess sewage volume $2Q_{on}$ over $Q_{on}$, for example, undergoes a simple treatment. The pre-planned sewage volume $Q_{in}$ is set as a sewage volume totaling the pre-planned interception volume $Q_{osn}$ and the maximum sewage volume $Q_{dn}$ that can be discharged into the public water body W without intervention of the sewage treatment plant 5. The excess sewage volume $Q_{\Delta n}$ is set as a sewage volume exceeding the pre-planned sewage volume $Q_{in}$ out of the sewage volume that has flowed into the confluence pipe 6.

Figure 3A:
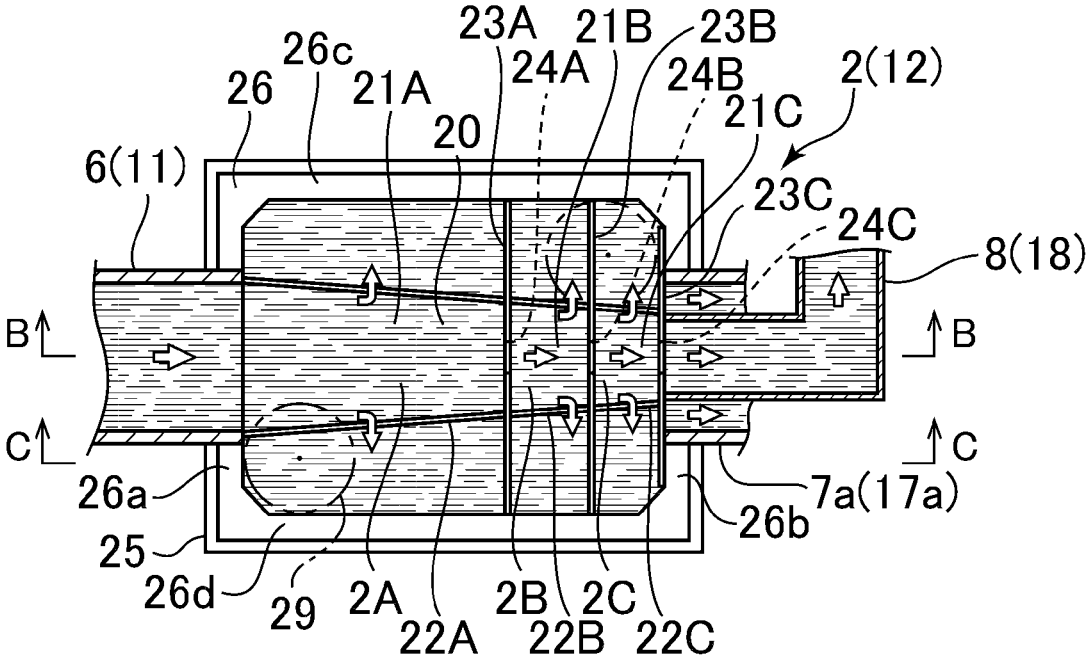
FIG. 3A is a partial cross-sectional plan view illustrating a state in which sewage or rainwater flows into the first water branching device included in the sewage system according to Embodiment 1 and Embodiment 2.

For example, under a heavy rainfall or a downpour, when a sewage volume flowing into the confluence pipe 6 has exceeded a pre-planned sewage volume $Q_{in}$ (when a sewage volume flowing into the confluence pipe 6 is defined as $Q_{in}+Q_{\Delta n}$), sewage coming from the confluence pipe 6 into the first water branching device 2 is, as illustrated in FIG. 3A, accurately controlled, in an nth drainage area, to separate into the following: sewage with a sewage volume being a pre-planned interception volume $Q_{osn}$, the sewage sequentially passing through the first regulating tank 2A, the first orifice 24A, the second regulating tank 2B, the second orifice 24B, the third regulating tank 2C and the third orifice 24C to flow into the intercepting pipe 8; and sewage with a sewage volume $Q_{in}-Q_{osn}+Q_{\Delta n}$, the sewage overflowing the first to third overflow weirs 22A, 22B, 22C to flow into the first discharge pipe 7*a*. The sewage overflowing the first to third overflow weirs 22A, 22B, 22C provided on both sides of the channel 20 flows down into the housing 26 and is then drained into the first discharge pipe 7*a* connected to the lower part of the housing 26.

Figure 3B:
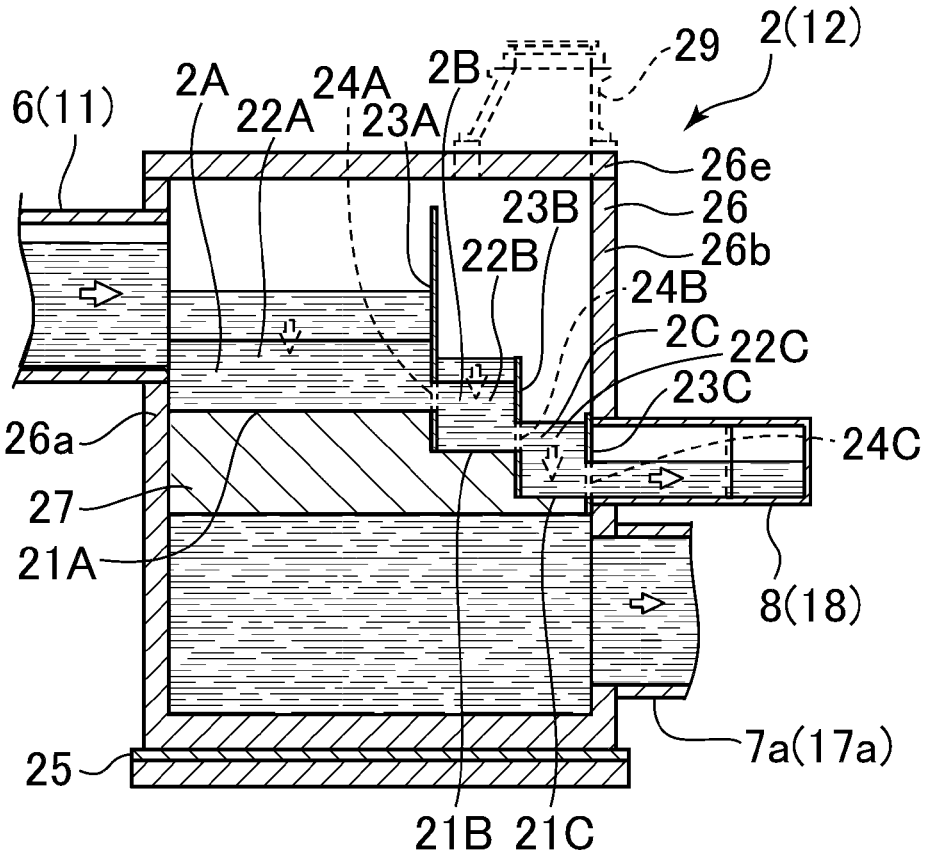
FIG. 3B is a cross-sectional view taken along line B-B of FIG. 3A.
Figure 3C:
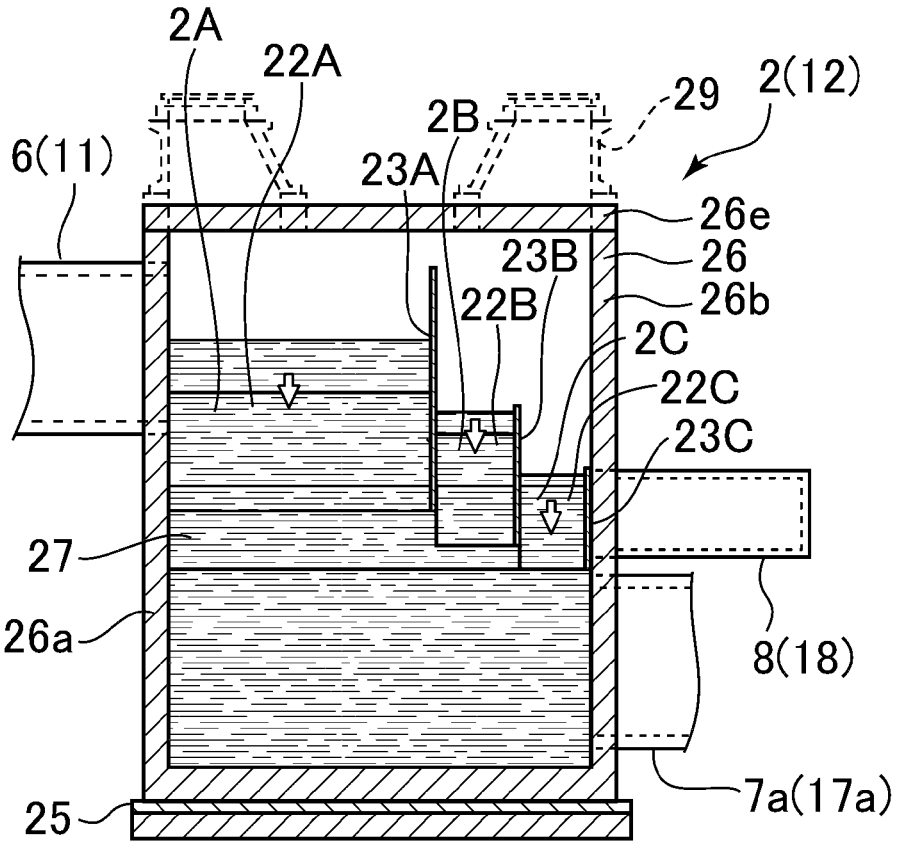
FIG. 3C is a cross-sectional view taken along line C-C of FIG. 3A.
Figure 4A:
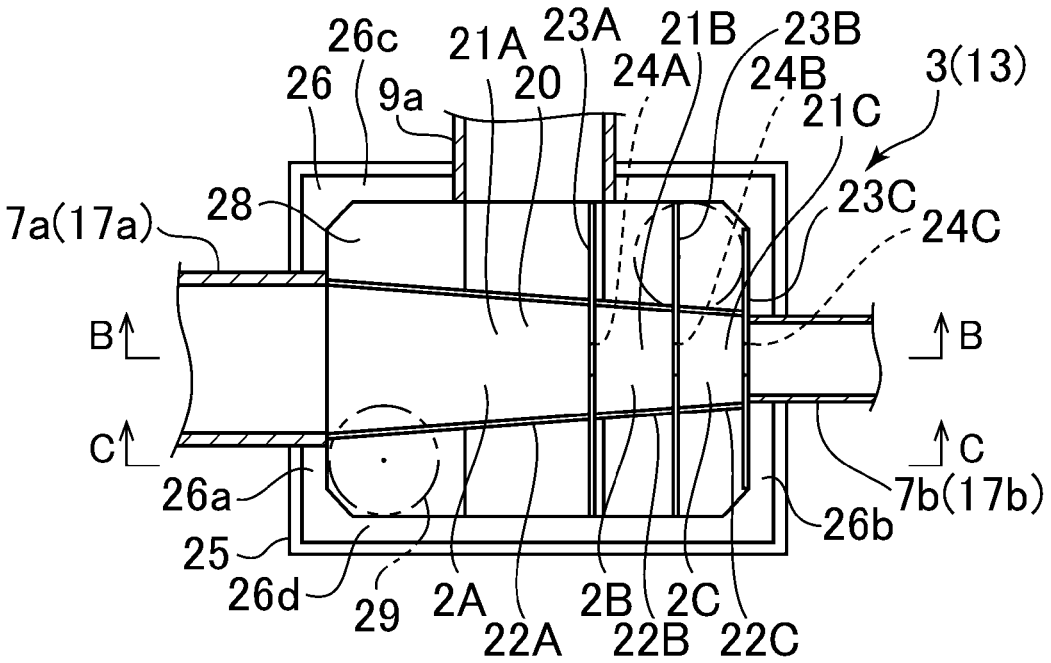
FIG. 4A is a partial cross-sectional plan view illustrating a configuration of a second water branching device included in the sewage system according to Embodiment 1 and Embodiment 2.
Figure 4B:
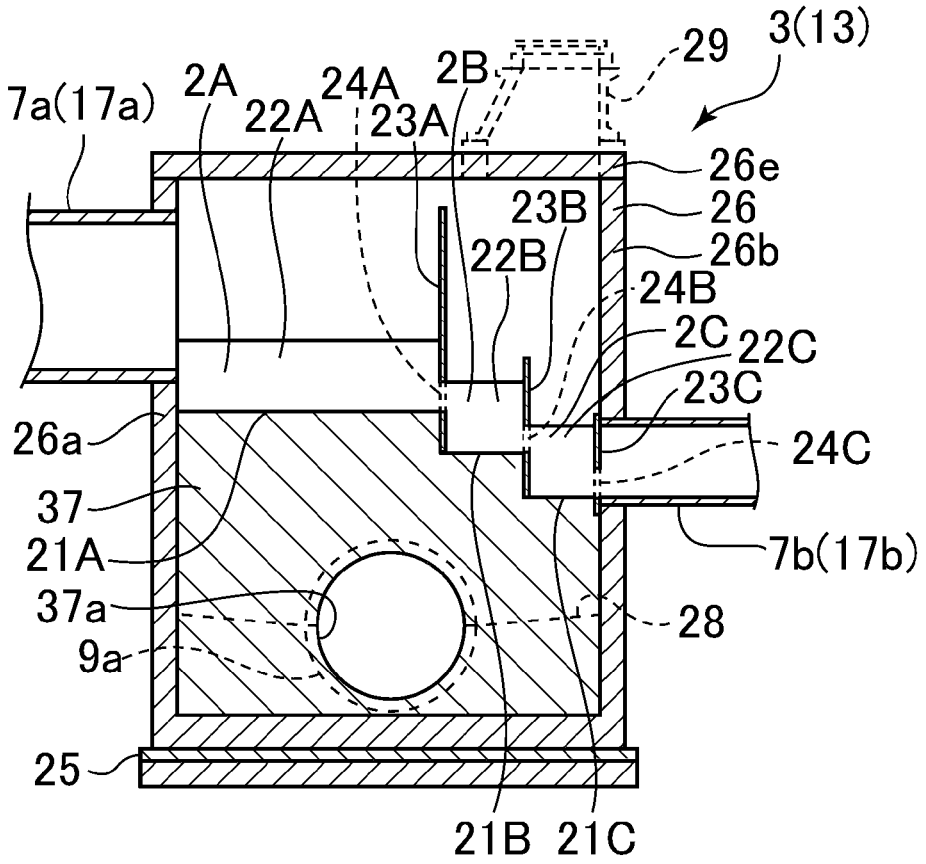
FIG. 4B is a cross-sectional view taken along line B-B of FIG. 4A.
Figure 4C:
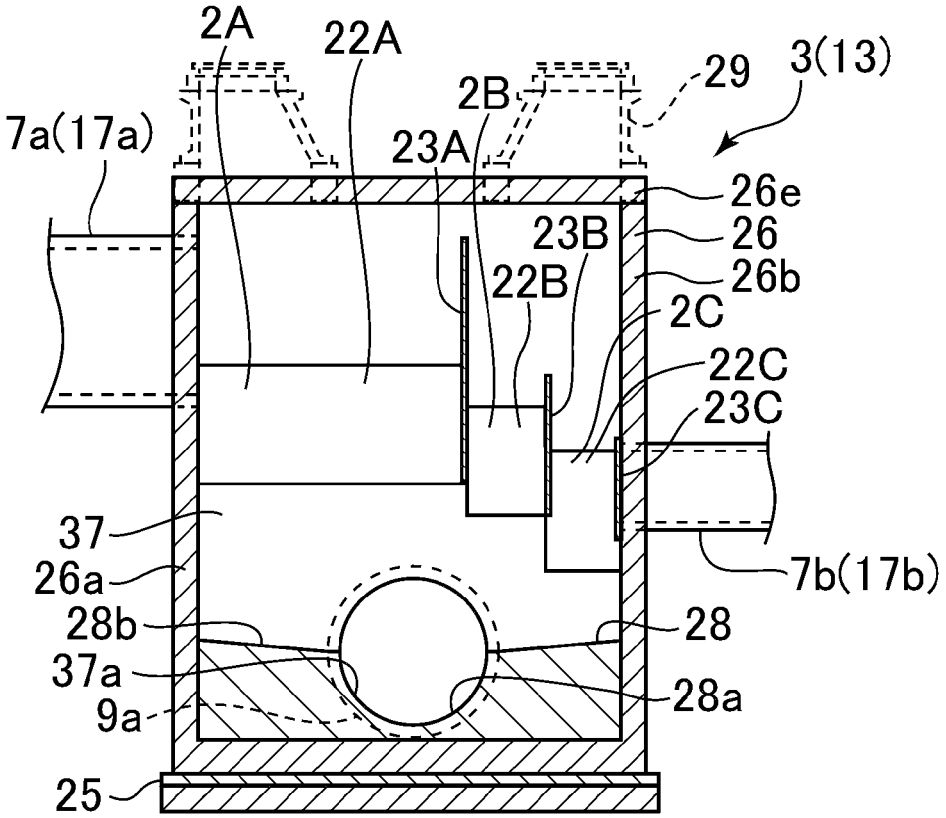
FIG. 4C is a cross-sectional view taken along line C-C of FIG. 4A.

Even when a sewage volume coming from the confluence pipe 6 has increased, the first water branching device 2 sequentially passes the introduced sewage, as illustrated in FIG. 3B, through the first regulating tank 2A, the first orifice 24A, the second regulating tank 2B and the second orifice 24B that are arranged upstream, thereby sequentially alleviating a rise in a water level in the regulating tanks. This reduces a width of variations in a water surface in the third regulating tank 2C arranged downstream and directly involved in interception and separation of water, thus suppressing variations in a sewage volume $Q_{osn}$ that is separated and drained into the intercepting pipe 8.

In the first regulating tank 2A arranged upstream and elongated in a direction of a channel, a complicated hydraulic phenomenon caused by incoming sewage released from the confluence pipe 6 is restricted and the incoming sewage is controlled substantially at a target separated flow volume. Subsequently, sewage that has passed through the first regulating tank 2A is caused to sequentially pass through the second regulating tank 2B, and then the third regulating tank 2C that is arranged downstream, thereby further improving an accuracy of water separation control and keeping a target separated flow volume.

Due to an increase in a sewage volume coming from the confluence pipe 6 into the first water branching device 2, an overflow depth of sewage overflowing the first overflow weir 22A increases suddenly in the first regulating tank 2A, which process is reactive. On the other hand, an overflow depth of sewage overflowing the second overflow weir 22B increases only slightly in the second regulating tank 2B and an overflow depth of sewage overflowing the third overflow weir 22C does not exceed that of the sewage overflowing the second overflow weir 22B in the third regulating tank 2C, which process is low-reactive.

Sewage with a sewage volume that is equal to a pre-planned interception volume $Q_{osn}$, the sewage being separated by the first water branching device 2 and flowing into the intercepting pipe 8, is drained into the sewage treatment plant 5 via the inflow pipe 8*a* for a sewage treatment plant. As described above, in the sewage treatment plant 5, a part of sewage corresponding to a sewage volume $Q_{on}$, for example, undergoes a higher treatment, and a part of sewage corresponding to a sewage volume $2Q_{on}$, for example, undergoes a simple treatment. Sewage purified in the sewage treatment plant 5 is discharged into the public water body W via the discharge pipe 8*b* for a sewage treatment plant.

Sewage with a sewage volume $Q_{in}-Q_{osn}+Q_{\Delta n}$, the sewage being separated by the first water branching device 2 and flowing into the first discharge pipe 7*a*, is drained into the second water branching device 3. Sewage flowing into the second water branching device 3 is accurately controlled to separate into the following: sewage with a maximum sewage volume $Q_{in}-Q_{osn}$ ($=Q_{dn}$) that can be discharged into the public water body W without intervention of the sewage treatment plant 5, the sewage sequentially passing through the first regulating tank 2A, the first orifice 24A, the second regulating tank 2B, the second orifice 24B, the third regulating tank 2C and the third orifice 24C to flow into the second discharge pipe 7*b*; and sewage with the excess sewage volume $Q_{\Delta n}$, the sewage overflowing the first to third overflow weirs 22A, 22B, 22C to flow into the inflow pipe 9*a* for a regulating reservoir. Sewage overflowing the first to third overflow weirs 22A, 22B, 22C provided on both sides of the channel 20 flows down toward the inclined path 28, and flows into the inflow pipe 9*a* for a regulating reservoir, directly from one side, and via the through hole 37*a* from the other side.

Figure 5A:
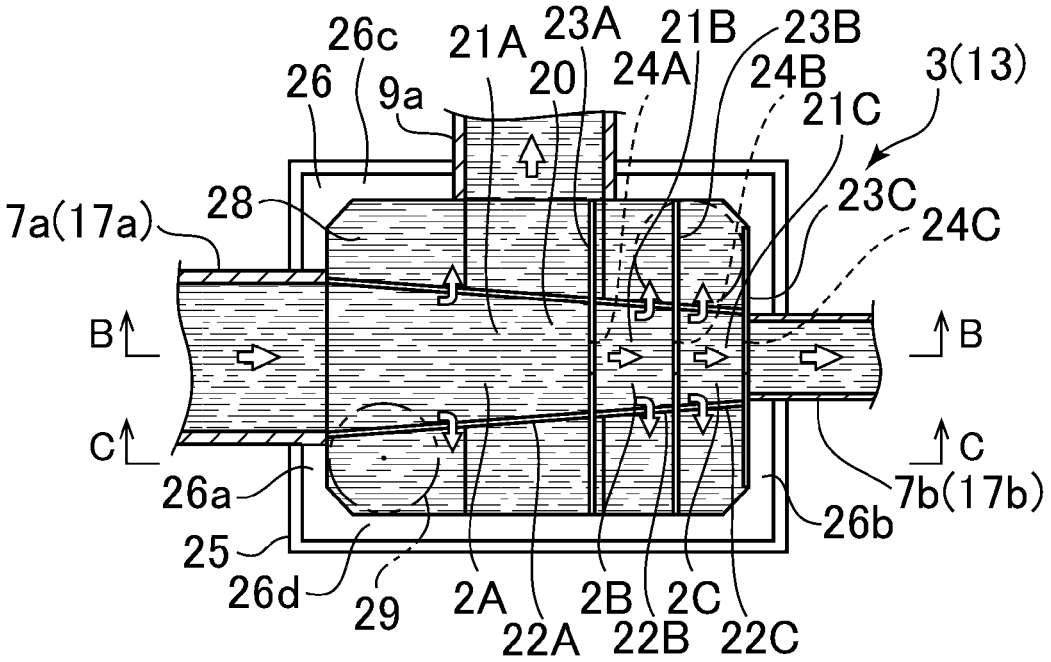
FIG. 5A is a partial cross-sectional plan view illustrating a state in which sewage or rainwater flows into the second water branching device included in the sewage system according to Embodiment 1 and Embodiment 2.
Figure 5B:
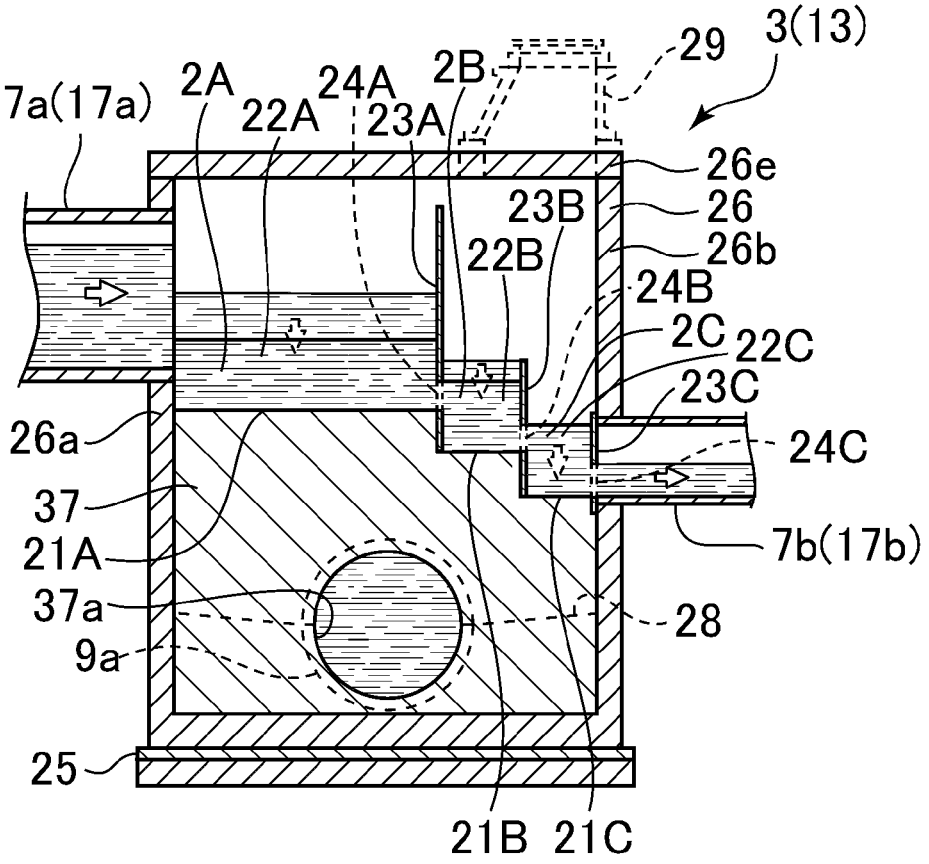
FIG. 5B is a cross-sectional view taken along line B-B of FIG. 5A.
Figure 5C:
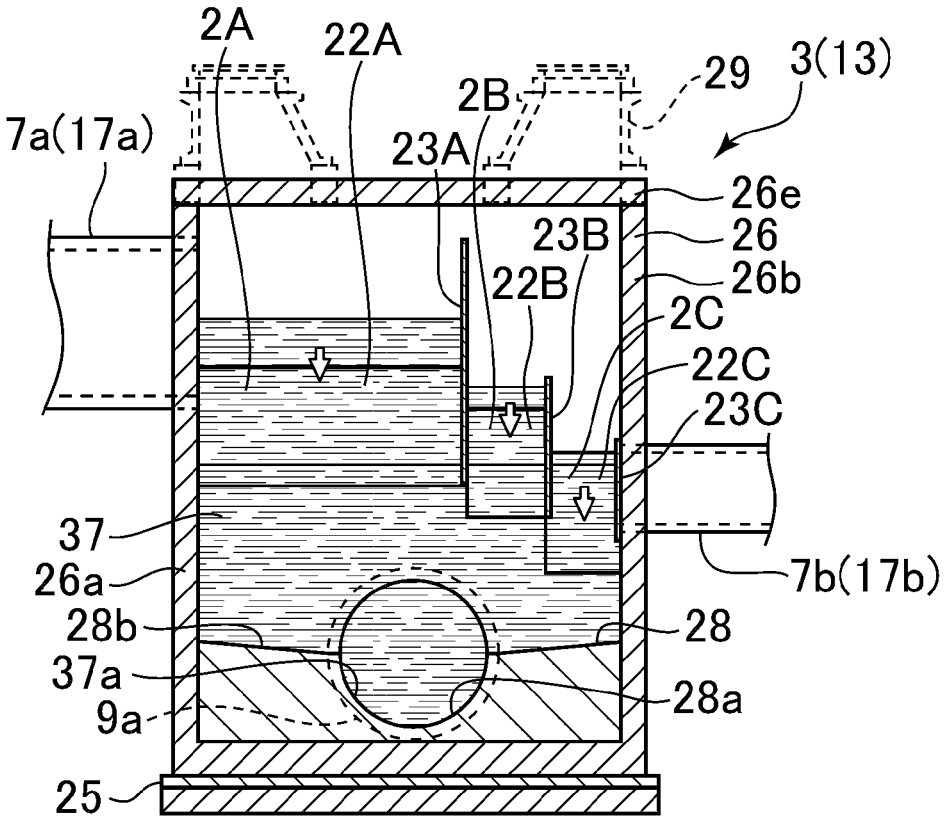
FIG. 5C is a cross-sectional view taken along line C-C of FIG. 5A.

Even when a sewage volume coming from the first discharge pipe 7*a* has increased, the second water branching device 3 sequentially passes the introduced sewage, as illustrated in FIG. 5B, through the first regulating tank 2A, the first orifice 24A, the second regulating tank 2B and the second orifice 24B that are arranged upstream, thereby sequentially alleviating a rise in a water level in the regulating tanks. This reduces a width of variations in a water surface in the third regulating tank 2C arranged downstream and directly involved in separation of sewage to be discharged into the public water body W, thus suppressing variations in a sewage volume $Q_{in}-Q_{osn}$ ($=Q_{dn}$) that is separated and drained into the second discharge pipe 7*b*.

In the first regulating tank 2A arranged upstream and elongated in a direction of a channel, a complicated hydraulic phenomenon caused by incoming sewage released from the first discharge pipe 7*a* is restricted and the incoming sewage is controlled substantially at a target separated flow volume. Subsequently, sewage that has passed through the first regulating tank 2A is caused to sequentially pass through the second regulating tank 2B, and then the third regulating tank 2C that is arranged downstream, thereby further improving an accuracy of water separation control and keeping a target separated flow volume.

Due to an increase in a sewage volume coming from the first discharge pipe 7*a* into the second water branching device 3, an overflow depth of sewage overflowing the first overflow weir 22A increases suddenly in the first regulating tank 2A, which process is reactive. On the other hand, an overflow depth of sewage overflowing the second overflow weir 22B increases only slightly in the second regulating tank 2B and an overflow depth of sewage overflowing the third overflow weir 22C does not exceed that of the sewage overflowing the second overflow weir 22B in the third regulating tank 2C, which process is low-reactive.

Sewage with a sewage volume $Q_{in}-Q_{osn}$ ($=Q_{dn}$), the sewage being separated by the second water branching device 3 and flowing into the second discharge pipe 7*b*, is drained into the public water body W. In other words, sewage with the maximum sewage volume $Q_{in}-Q_{osn}$ ($=Q_{dn}$) that can be discharged without intervention of the sewage treatment plant 5, is discharged into the public water body W. Sewage with the excess sewage volume $Q_{\Delta n}$, the sewage being separated by the second water branching device 3 and flowing into the inflow pipe 9*a* for a regulating reservoir is drained into the regulating reservoir 4 and is temporarily stored in the regulating reservoir 4.

After a rainfall, sewage temporarily stored in the regulating reservoir 4 is discharged, by a sewage volume within $Q_{in}-Q_{osn}$ ($=Q_{dn}$), into the public water body W via the discharge pipe 9*c* for a regulating reservoir and the second discharge pipe 7*b*. The sewage may be discharged from the discharge pipe 9*c* for a regulating reservoir into the public water body W without intervention of the second discharge pipe 7*b*. By providing the regulating reservoir 4 with a water gauge (not illustrated), sewage stored in the regulating reservoir 4 is drained into the sewage treatment plant 5, for example by a sewage volume not exceeding $2Q_{on}$, via the discharge pipe 9*b* for a regulating reservoir and the inflow pipe 8*a* for a sewage treatment plant, as long as a predetermined water level is not exceeded. Sewage drained into the sewage treatment plant 5 is purified in the sewage treatment plant 5 and the purified sewage is discharged into the public water body W. This prevents dirt accumulated near the bottom of the regulating reservoir 4 from being discharged into the public water body W.

In the combined sewage system according to the present embodiment, even under a heavy rainfall or a downpour, for example, the first water branching device 2 sequentially passes sewage coming from the confluence pipe 6 through the first regulating tank 2A, the first orifice 24A, the second regulating tank 2B, the second orifice 24B, the third regulating tank 2C and the third orifice 24C. As a result, the combined sewage system can accurately separate and intercept sewage with a target pre-planned interception volume $Q_{osn}$ in each drainage area. This allows the combined sewage system according to the present embodiment to avoid problems with a sewage treatment plant or the like, including a problem of flow interception and combination that an intercepting pipe collects water again as a confluence pipe, an accident in a pipe facility caused by excessive interception, and discharge of nontreated sewage.

In the combined sewage system according to the present embodiment, for example, even under a heavy rainfall or a downpour, the second water branching device 3 sequentially passes sewage separated from sewage with the pre-planned interception volume $Q_{osn}$ by the first water branching device 2 through the first regulating tank 2A, the first orifice 24A, the second regulating tank 2B, the second orifice 24B, the third regulating tank 2C and the third orifice 24C. This makes it possible to accurately separate and discharge sewage with the target maximum sewage volume $Q_{in}-Q_{osn}$ ($=Q_{dn}$) in each drainage area, the sewage being dischargeable into the public water body W without intervention of the sewage treatment plant 5. This reliably prevents, for example, flooding of the public water body W and makes it possible to store only an excess sewage volume $Q_{\Delta n}$ in the regulating reservoir 4, thereby reducing a capacity requirement of a regulating reservoir.

Figure 6A:
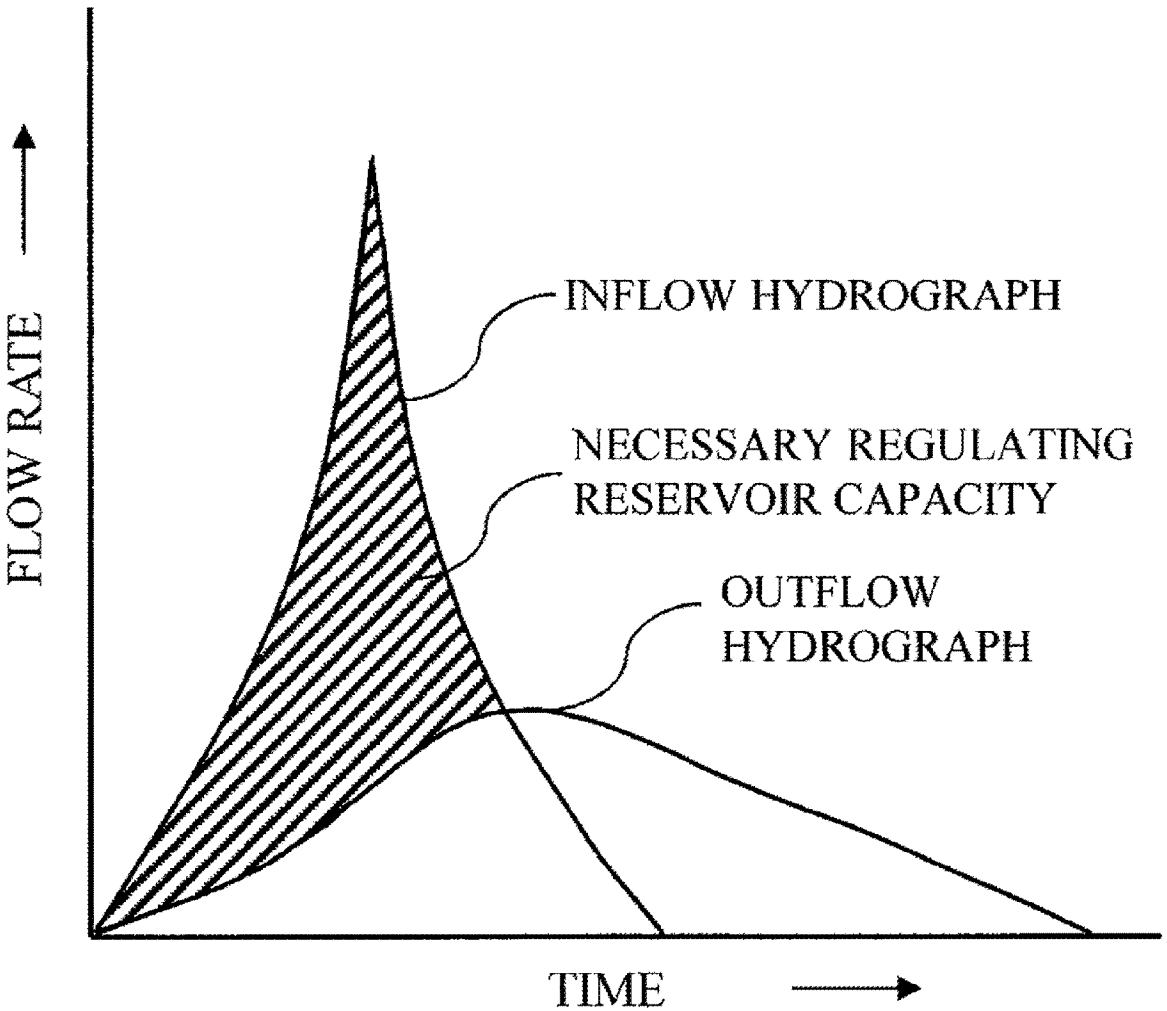
FIG. 6A is a graph illustrating a capacity requirement of a regulating reservoir in a conventional sewage system.
Figure 6B:
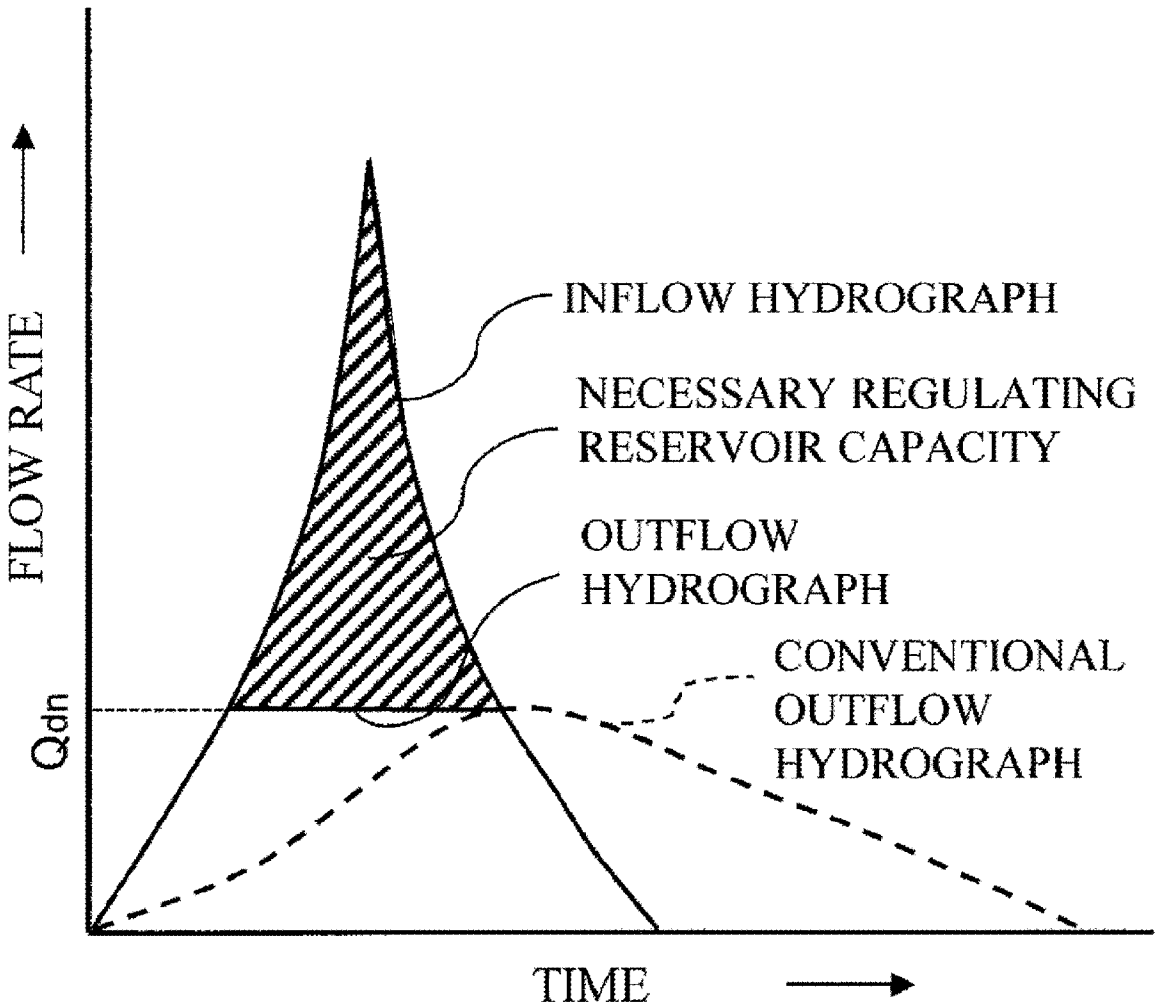
FIG. 6B is a graph illustrating a capacity requirement of a regulating reservoir in the sewage system according to Embodiment 1.

Comparison between a capacity requirement of a regulating reservoir in the sewage system according to the present embodiment and that in a conventional sewage system is described below by using FIGS. 6A and 6B. In a conventional sewage system, as illustrated in FIG. 6A, a capacity requirement of a regulating reservoir is represented by a hatched area that is a difference between an inflow hydrograph of sewage flowing into a regulating reservoir and an outflow hydrograph of sewage discharged from an orifice provided as an outlet of a regulating reservoir. On the other hand, in the sewage system according to the present embodiment, as illustrated in FIG. 6B, a capacity requirement of a regulating reservoir is represented by a hatched area that is a difference between an inflow hydrograph of sewage flowing into a second water branching device 3 and an outflow hydrograph of sewage flowing from the second water branching device 3 and discharged into the public water body W. In the sewage system according to the present embodiment, sewage with a maximum dischargeable sewage volume $Q_{dn}$ is discharged into the public water body W and only the excess sewage volume $Q_{\Delta n}$ over the sewage volume $Q_{in}$ is efficiently stored in the regulating reservoir 4. It is clear that a capacity requirement of a regulating reservoir is reduced in comparison with a conventional sewage system.

When an inflow hydrograph is shifted backward to behind a rainfall waveform in the case of an actual rainfall having a complicated rainfall waveform or in the presence of stagnant water on the ground from a heavy rainfall due to a limited inflow pipe capacity, it is worried that a capacity requirement of a regulating reservoir may be increased or a discharge volume may exceed a set value in a conventional combined sewage system. Even under such circumstances, a combined sewage system according to the present embodiment can accurately separate sewage with the maximum dischargeable volume $Q_{dn}$ and discharge the separated sewage into the public water body W while reliably storing only the excess sewage volume $Q_{\Delta n}$ in the regulating reservoir 4. This avoids an increase in a capacity requirement of a regulating reservoir and prevents a discharge volume from exceeding a set value.

In the combined sewage system according to the present embodiment, the first water branching device 2 and the second water branching device 3 each include the first to third overflow weirs 22A, 22B, 22C provided on both sides of the channel 20. An overall length of the weirs increases to stabilize a hydraulic phenomenon and it is made possible to downsize the housing 26.

Embodiment 2

A sewage system according to Embodiment 2 is described below with reference to FIGS. 2A to 2C, FIGS. 3A to 3C, FIGS. 4A to 4C, FIGS. 5A to 5C, and FIG. 7. The sewage system according to Embodiment 2 is a separated sewage system that is a sewage system to drain rainwater and wastewater through separate pipes. In Embodiment 2, the same sign is given to the same component as that of the sewage system according to Embodiment 1 and a description thereof is basically omitted, and differences from Embodiment 1 are mainly discussed. A first water branching device 12 and a second water branching device 13 in the sewage system according to Embodiment 2 have substantially the same configuration as that of the first water branching device 2 and the second water branching device 3 in Embodiment 1, respectively, so that the following description will refer to FIGS. 2A to 2C, FIGS. 3A to 3C, FIGS. 4A to 4C, and FIGS. 5A to 5C also in Embodiment 2.

Figure 7:
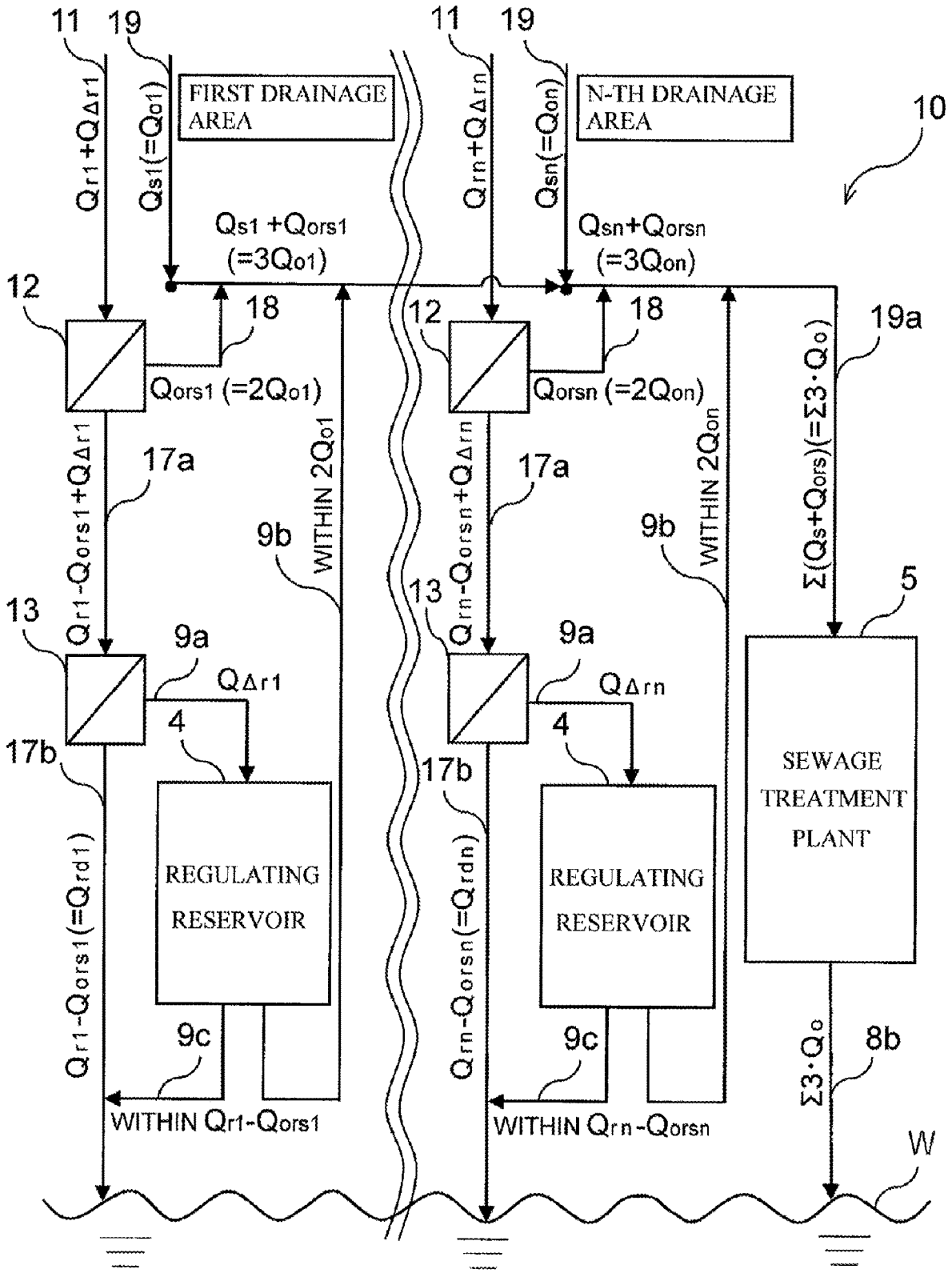
FIG. 7 is a block diagram illustrating a configuration of a separated sewage system according to Embodiment 2 of the disclosure.

The separated sewage system 10 includes, as illustrated in FIG. 7, a first water branching device 12, a second water branching device 13, and the regulating reservoir 4 in each drainage area, as well as the sewage treatment plant 5 that purifies rainwater and wastewater separated in all drainage areas. The separated sewage system 10 includes, in each drainage area, a rainwater pipe 11 that introduces incoming rainwater and drains the introduced rainwater into the first water branching device 12, a first discharge pipe 17*a* that drains one part of rainwater separated by the first water branching device 12 into the second water branching device 13, an intercepting pipe 18 that drains the other part of rainwater separated by the first water branching device 12 into the sewage treatment plant 5, a second discharge pipe 17*b* that discharges one part of rainwater separated by the second water branching device 13 into the public water body W, and the inflow pipe 9*a* for a regulating reservoir that drains the other part of rainwater separated by the second water branching device 13 into the regulating reservoir 4.

The separated sewage system 10 includes, in each drainage area, the discharge pipe 9*b* for a regulating reservoir that drains rainwater from the regulating reservoir 4 into the sewage treatment plant 5 after a rainfall and the discharge pipe 9*c* for a regulating reservoir that discharges rainwater from the regulating reservoir 4 into the public water body W after a rainfall.

The separated sewage system 10 includes, in each drainage area, a wastewater pipe 19 that introduces wastewater and drains the introduced wastewater into the sewage treatment plant 5, the inflow pipe 19*a* for a sewage treatment plant to which the wastewater pipe 19 and the intercepting pipe 18 in each drainage area are connected, and into which both wastewater from the wastewater pipe 19 and the other part of rainwater separated by the first water branching device 12 are introduced, an inflow pipe 19*a* for a sewage treatment plant draining the introduced wastewater and rainwater into the sewage treatment plant 5, and the discharge pipe 8*b* for a sewage treatment plant that discharges purified sewage from the sewage treatment plant 5 into the public water body W.

The first water branching device 12 is a unit capable of accurately separating rainwater coming from the rainwater pipe 11 into the following: rainwater with a desired rainwater volume to be drained into the sewage treatment plant 5 via the intercepting pipe 18 and the inflow pipe 19*a* for a sewage treatment plant; and rainwater to be drained into the second water branching device 13 via the first discharge pipe 17*a*. In a conventional separated sewage system, there is a problem caused by nonpoint pollution that pollutant substances deposited on a road surface in an urban area or the like are carried by rainwater and flow into a rainwater pipe. The separated sewage system according to the present embodiment provides nonpoint load countermeasures by way of the first water branching device 12.

As illustrated in FIGS. 2A to 2C and FIGS. 3A to 3C, the rainwater pipe 11 is connected to the side wall 26*a* upstream of the housing 26 and rainwater flows from the rainwater pipe 11 into the first regulating tank 2A. The intercepting pipe 18 is connected to the side wall 26*b* arranged downstream opposed to the side wall 26*a* upstream of the housing 26 and rainwater flows from the third regulating tank 2C into the intercepting pipe 18. In other words, a channel 20 is configured in which rainwater coming from the rainwater pipe 11 flows into the intercepting pipe 18. A first discharge pipe 17*a* is connected below the intercepting pipe 18 on the side wall 26*b* downstream of the housing 26. The first discharge pipe 17*a* is connected to the center of a lower part of the side wall 26*b* and arranged below the first to third regulating tanks 2A, 2B, 2C. While the intercepting pipe 18 is curved in an L shape to allow connection to the inflow pipe 19*a* for a sewage treatment plant, a shape or the like of the intercepting pipe 18 may undergo modifications as appropriate depending on an arrangement plan of each facility or the like.

A height of the first overflow weir 22A arranged upstream is set in accordance with a water level of rainwater with a pre-planned interception volume $Q_{orsn}$ of nonpoint load countermeasures described later has flowed into rainwater pipe 11. When a height of the first overflow weir 22A is set higher than the water level of rainwater with the pre-planned interception volume $Q_{orsn}$ of nonpoint load countermeasures that has flowed into the rainwater pipe 11, a backwater effect is triggered inside the rainwater pipe 11, resulting in a decrease in a downward flow capacity in the rainwater pipe 11 or retention or sedimentation of a pollution load in the rainwater pipe 11.

The first partition 23A and the second partition 23B are constructed between the side wall 26*c* and the side wall 26*d*, which avoids an influence of waves caused when rainwater overflowing the first overflow weir 22A and the second overflow weir 22B falls into the third regulating tank 2C.

The second water branching device 13 is a unit capable of accurately separating rainwater separated by the first water branching device 12 and coming from the first discharge pipe 17*a* into the following: rainwater with a desired rainwater volume to be discharged into the public water body W via the second discharge pipe 17*b*; and rainwater with a desired rainwater volume to be drained into the regulating reservoir 4 via the inflow pipe 9*a* for a regulating reservoir. In the second water branching device 13, as illustrated in FIGS. 4A to 4C and FIGS. 5A to 5C, the first discharge pipe 17*a* is connected to the side wall 26*a* upstream of the housing 26, and rainwater flows from the first discharge pipe 17*a* into the first regulating tank 2A. The second discharge pipe 17*b* is connected to the side wall 26*b* arranged downstream, and rainwater flows from the third regulating tank 2C into the second discharge pipe 17*b*. In other words, the channel 20 is configured in which rainwater coming from the first discharge pipe 17*a* flows into the second discharge pipe 17*b*. To the side wall 26*c* orthogonal to the side walls 26*a*, 26*b* of the housing 26 is connected the inflow pipe 9*a* for a regulating reservoir. The inflow pipe 9*a* for a regulating reservoir is connected to the center of the lower part of the side wall 26*c* and arranged below the first to third regulating tanks 2A, 2B, 2C.

In the second water branching device 13, a height of the third overflow weir 22C arranged downstream is set higher than a rainwater level of sewage overflowing the first to third overflow weirs 22A, 22B, 22C to flow down into the inclined path 28. In the second water branching device 13, a height of the first overflow weir 22A of the first regulatory tank 2A arranged upstream is set in accordance with a water level of rainwater with a rainwater volume $Q_m - Q_{orsn}$ ($=Q_{rdn}$) ($Q_m$, $Q_{orsn}$ and $Q_{rdn}$ are described later) that has flowed into the first discharge pipe 17*a*.

The regulating reservoir 4 is a facility that temporarily stores and regulates rainwater separated by the second water branching device 13 in order to prevent possible flooding caused by discharge of rainwater into the public water body W under a heavy rainfall. The sewage treatment plant 5 is a facility that purifies and discharges, into the public water body W, the following: rainwater separated by the first water branching device 12 and coming from the inflow pipe 19*a* for a sewage treatment plant via the intercepting pipe 18; wastewater coming from the inflow pipe 19*a* for a sewage treatment plant via the wastewater pipe 19; and rainwater with a predetermined volume temporarily stored in the regulating reservoir 4 and coming from the inflow pipe 19*a* for a sewage treatment plant via the outflow pipe 9*b* for a regulating reservoir. The sewage treatment plant 5 performs, for example, a higher treatment in which incoming wastewater and rainwater undergo a sedimentation treatment, a biological treatment and a disinfection treatment and then discharges the treated wastewater and rainwater, or performs a simple treatment in which incoming wastewater and rainwater undergo only a sedimentation treatment and a disinfection treatment and then discharges the treated wastewater and rainwater. Sewage to undergo a simple treatment may be temporarily stored in a storage facility before undergoing a higher treatment.

Next, a method for treating sewage by using the separated sewage system 10 will be described. Assume that, in an nth drainage area, a pre-planned interception volume of nonpoint load countermeasures is defined as $Q_{orsn}$, a pre-planned rainwater volume is defined as $Q_m$, an excess rainwater volume is defined as $Q_{\Delta m}$, a pre-planned wastewater volume is defined as $Q_{sn}$, and a maximum rainwater volume that can be discharged into the public water body W without intervention of the sewage treatment plant 5 is defined as $Q_{rdn}$ (n is a natural number). The pre-planned interception volume of nonpoint load countermeasures $Q_{orsn}$ is set in consideration of an outflow load volume from a nonpoint pollution source and the like, and set to, for example, twice a maximum hourly wastewater volume under a fine weather $Q_{on}$. A pre-planned rainwater volume $Q_m$ is set as a rainwater volume totaling the pre-planned interception volume of nonpoint load countermeasures $Q_{osn}$ and the maximum rainwater volume $Q_{rdn}$ dischargeable into the public water body W. An excess rainwater volume $Q_{\Delta m}$ is set as a rainwater volume exceeding the pre-planned rainwater volume $Q_m$ out of the rainwater volume that has flowed into the rainwater pipe 11. The pre-planned wastewater volume $Q_{sn}$ is set in consideration of, for example, the maximum hourly wastewater volume under a fine weather $Q_{on}$ and set to, for example, the maximum hourly wastewater volume under a fine weather $Q_{on}$.

When a rainfall volume flowing into the rainwater pipe 11 does not exceed the pre-planned interception volume $Q_{orsn}$ of nonpoint load countermeasures, for example, when it has started to rain or a rainfall volume is small, rainwater coming from the rainwater pipe 11 into the first water branching device 12 sequentially passes, in an nth drainage area, through the first regulating tank 2A, the first orifice 24A, the second regulating tank 2B, the second orifice 24B, the third regulating tank 2C and the third orifice 24C, without overflowing the first to third overflow weirs 22A, 22B, 22C, to flow totally into the intercepting pipe 18. Rainwater flowing into the intercepting pipe 18 is drained into the sewage treatment plant 5 via the inflow pipe 19*a* for a sewage treatment plant. Wastewater is drained from the wastewater pipe 19 into the sewage treatment plant 5 via the inflow pipe 19*a* for a sewage treatment plant. Rainwater coming from the intercepting pipe 18 and wastewater coming from the wastewater pipe 19 undergo a higher treatment or a simple treatment in the sewage treatment plant 5. Rainwater and wastewater purified in the sewage treatment plant 5 is discharged into the public water body W via the discharge pipe 8*b* for a sewage treatment plant. When it has started to rain, for example, there may occur a problem caused by nonpoint pollution that pollutant substances deposited on a road surface in an urban area or the like flows into a rainwater pipe. The separated sewage system 10 can purify, in the sewage treatment plant 5, a total volume of rainwater flowing into the rainwater pipe 11, thereby solving this problem.

For example, under a heavy rainfall or a downpour, when a rainwater volume flowing into the rainwater pipe 11 has exceeded the pre-planned rainwater volume $Q_m$ (when a rainwater volume flowing into the rainwater pipe 11 is $Q_m + Q_{\Delta m}$), as illustrated in FIG. 3A, rainwater flowing from the rainwater pipe 11 into the first water branching device 12 is accurately controlled, in an nth drainage area, to separate into the following: rainwater with the pre-planned interception volume $Q_{orsn}$, the rainwater sequentially passing through the first regulating tank 2A, the first orifice 24A, the second regulating tank 2B, the second orifice 24B, the third regulating tank 2C and the third orifice 24C to flow into the intercepting pipe 18; and rainwater with the rainwater volume $Q_m-Q_{orsn}+Q_{\Delta m}$, the rainwater overflowing the first to third overflow weirs 22A, 22B, 22C to flow into the first discharge pipe 17*a*. Rainwater overflowing the first to third overflow weirs 22A, 22B, 22C provided on both sides of the channel 20 flows down into the housing 26 and is discharged into the first discharge pipe 17*a* connected to the lower part of the housing 26.

Even when a rainwater volume coming from the rainwater pipe 11 has increased, the first water branching device 12 sequentially passes the introduced rainwater, as illustrated in FIG. 3B, through the first regulating tank 2A, the first orifice 24A, the second regulating tank 2B and the second orifice 24B that are arranged upstream, thereby sequentially alleviating a rise in a water level in the regulating tanks. This reduces a width of variations in a water surface in the third regulating tank 2C arranged downstream and directly involved in interception and separation of water, thus suppressing variations in a rainwater volume $Q_{orsn}$ that is separated and drained into the intercepting pipe 18.

In the first regulating tank 2A arranged upstream and elongated in a direction of a channel, a complicated hydraulic phenomenon caused by incoming rainwater released from the rainwater pipe 11 is restricted and the incoming rainwater is controlled substantially at a target separated flow volume. Subsequently, rainwater that has passed through the first regulating tank 2A is caused to sequentially pass through the second regulating tank 2B, and then the third regulating tank 2C that is arranged downstream, thereby further improving an accuracy of water separation control and keeping a target separated flow volume.

Due to an increase in a rainwater volume coming from the rainwater pipe 11 into the first water branching device 12, an overflow depth of rainwater overflowing the first overflow weir 22A increases suddenly in the first regulating tank 2A, which process is reactive. On the other hand, an overflow depth of rainwater overflowing the second overflow weir 22B increases only slightly in the second regulating tank 2B and an overflow depth of rainwater overflowing the third overflow weir 22C does not exceed that of the rainwater overflowing the second overflow weir 22B in the third regulating tank 2C, which process is low-reactive.

Rainwater with a pre-planned interception volume $Q_{orsn}$, the rainwater being separated by the first water branching device 12 and flowing into the intercepting pipe 18, is drained into the sewage treatment plant 5 via the inflow pipe 19*a* for a sewage treatment plant. Wastewater with, for example, a pre-planned wastewater volume $Q_{sn}$ is drained from the wastewater pipe 19 into the sewage treatment plant 5 via the inflow pipe 19*a* for a sewage treatment plant. In the sewage treatment plant 5, sewage corresponding to a sewage volume $Q_{on}$, for example, undergoes a higher treatment and sewage corresponding to a sewage volume $2Q_{on}$, for example, undergoes a simple treatment. Sewage purified in the sewage treatment plant 5 is discharged into the public water body W via the discharge pipe 8*b* for a sewage treatment plant.

Rainwater with a rainwater volume $Q_m-Q_{orsn}+Q_{\Delta m}$, the rainwater being separated by the first water branching device 12 and flowing into the first discharge pipe 17*a*, is drained into the second water branching device 13. Rainwater flowing into the second water branching device 13 is accurately controlled to separate into the following: rainwater with a maximum rainwater volume $Q_m-Q_{orsn}$ ($=Q_{rdn}$) that can be discharged into the public water body W, the rainwater sequentially passing through the first regulating tank 2A, the first orifice 24A, the second regulating tank 2B, the second orifice 24B, the third regulating tank 2C and the third orifice 24C to flow into the second discharge pipe 17*b*; and rainwater with the excess sewage volume $Q_{\Delta m}$, the rainwater overflowing the first to third overflow weirs 22A, 22B, 22C to flow into the inflow pipe 9*a* for a regulating reservoir. Rainwater overflowing the first to third overflow weirs 22A, 22B, 22C provided on both sides of the channel 20 flows down toward the inclined path 28, and flows into the inflow pipe 9*a* for a regulating reservoir, directly from one side, and via the through hole 37*a* from the other side.

Even when a rainwater volume coming from the first discharge pipe 17*a* has increased, the second water branching device 13 sequentially passes the introduced rainwater, as illustrated in FIG. 5B, through the first regulating tank 2A, the first orifice 24A, the second regulating tank 2B and the second orifice 24B that are arranged upstream, thereby sequentially alleviating a rise in a water level in the regulating tanks. This reduces a width of variations in a water surface in the third regulating tank 2C arranged downstream and directly involved in separation of rainwater to be discharged into the public water body W, thus suppressing variations in the rainwater volume $Q_m-Q_{orsn}$ ($=Q_{rdn}$) that is separated and drained into the second discharge pipe 17*b*.

In the first regulating tank 2A arranged upstream and elongated in a direction of a channel, a complicated hydraulic phenomenon caused by incoming rainwater released from the first discharge pipe 17*a* is restricted and the incoming rainwater is controlled substantially at a target separated flow volume. Subsequently, rainwater that has passed through the first regulating tank 2A is caused to sequentially pass through the second regulating tank 2B, and then the third regulating tank 2C that is arranged downstream, thereby further improving an accuracy of water separation control and keeping a target separated flow volume.

Due to an increase in a rainwater volume coming from the first discharge pipe 17*a* into the second water branching device 13, an overflow depth of rainwater overflowing the first overflow weir 22A increases suddenly in the first regulating tank 2A, which process is reactive. On the other hand, an overflow depth of rainwater overflowing the second overflow weir 22B increases only slightly in the second regulating tank 2B and an overflow depth of rainwater overflowing the third overflow weir 22C does not exceed that of the rainwater overflowing the second overflow weir 22B in the third regulating tank 2C, which process is low-reactive.

Rainwater with the rainwater volume $Q_m-Q_{orsn}$ ($=Q_{rdn}$), the rainwater being separated by the second water branching device 13 and flowing into the second discharge pipe 17*b*, is discharged into the public water body W. In other words, rainwater with the maximum dischargeable rainwater volume $Q_m-Q_{orsn}$ ($=Q_{rdn}$) is discharged into the public water body W. Rainwater with the excess rainwater volume $Q_{\Delta m}$, the rainwater being separated by the second water branching device 13 and flowing into the inflow pipe 9*a* for a regulating reservoir is drained into the regulating reservoir 4 and is temporarily stored in the regulating reservoir 4.

After a rainfall, rainwater temporarily stored in the regulating reservoir 4 is discharged, by a rainwater volume not exceeding $Q_m - Q_{orsn}$ ($=Q_{rdn}$), into the public water body W via the discharge pipe 9*c* for a regulating reservoir and the second discharge pipe 17*b*. The rainwater may be discharged from the discharge pipe 9*c* for a regulating reservoir into the public water body W without intervention of the second discharge pipe 17*b*. By providing the regulating reservoir 4 with the water gauge (not illustrated), rainwater stored in the regulating reservoir 4 is drained into the sewage treatment plant 5, for example by a rainwater volume not exceeding $2Q_{on}$, via the discharge pipe 9*b* for a regulating reservoir and the inflow pipe 19*a* for a sewage treatment plant, as long as a predetermined water level is not exceeded. Rainwater drained into the sewage treatment plant 5 is purified in the sewage treatment plant 5 and the purified rainwater is discharged into the public water body W. This prevents dirt accumulated near the bottom of the regulating reservoir 4 from being discharged into the public water body W.

When a rainwater volume flowing into the rainwater pipe 11 exceeds the pre-planned interception volume $Q_{orsn}$ and does not exceed the pre-planned rainwater volume $Q_m$, the rainwater is accurately controlled, in an nth drainage area, to separate into the following: rainwater with pre-planned interception volume $Q_{orsn}$, the rainwater sequentially passing through the first regulating tank 2A, the first orifice 24A, the second regulating tank 2B, the second orifice 24B, the third regulating tank 2C and the third orifice 24C to flow into the intercepting pipe 18; and rainwater with the remaining rainwater volume, the rainwater overflowing the first to third overflow weirs 22A, 22B, 22C provided on both sides of the channel 20 to flow into the first discharge pipe 17*a*.

Rainwater with a rainwater volume being the pre-planned interception volume $Q_{orsn}$, the rainwater separated by the first water branching device 12 and flowing into the intercepting pipe 18 is drained into the sewage treating plant 5 via the inflow pipe 19*a* for a sewage treatment plant and purified, together with, for example, wastewater with the pre-planned wastewater volume $Q_{sn}$, the wastewater flowing into the wastewater pipe 19. The purified sewage is discharged into the public water body W via the discharge pipe 8*b* for a sewage treatment plant.

Rainwater separated by the first water branching device 12 and flowing into the first discharge pipe 17*a* flows into the second water branching device 13, and sequentially passes through the first regulating tank 2A, the first orifice 24A, the second regulating tank 2B, the second orifice 24B, the third regulating tank 2C and the third orifice 24C to flow totally into the second discharge pipe 17*b* and is then discharged into the public water body W, without overflowing the first to third overflow weirs 22A, 22B, 22C.

In this way, in the separated sewage system according to the present embodiment, when a rainfall volume flowing into the rainwater pipe 11 does not exceed the pre-planned interception volume $Q_{orsn}$ of nonpoint load countermeasures, for example, when it has started to rain, in an nth drainage area, rainwater coming into the rainwater pipe 11 are drained totally into the intercepting pipe 18 by the first water branching device 12 and an entire volume of rainwater flowing into the rainwater pipe 11 can be purified in the sewage treatment plant 5. When a volume of rainwater flowing into the rainwater pipe 11 has exceeded the pre-planned interception volume $Q_{orsn}$, rainwater flowing into the rainwater pipe 11 is caused to sequentially pass through the first regulating tank 2A, the first orifice 24A, the second regulating tank 2B, the second orifice 24B, the third regulating tank 2C and the third orifice 24C in the first water branching device 12. This makes it possible to accurately separate and intercept rainwater with the target pre-planned interception volume $Q_{orsn}$ of nonpoint load countermeasures in each drainage area. As a result, it is possible to effectively solve a problem caused by nonpoint pollution.

As described above, in the separated sewage system according to the present embodiment, a problem caused by nonpoint pollution is effectively solved by the first water branching device 12, which substantially reduces pollutant substances contained in rainwater flowing into the second water branching device 13. This prevents pollution of the public water body W caused by rainwater discharged from the second water branching device 13 via the second discharge pipe 17*b*. Further, it is possible to utilize rainwater flowing from the second water branching device 13 into the regulating reservoir 4 via the inflow pipe 9*a* for a regulating reservoir and stored in the regulating reservoir 4 in such applications as groundwater recharge, watering and green infrastructure projects.

In the separated sewage system according to the present embodiment, under a heavy rainfall or a downpour, for example, rainwater separated by the first water branching device 12 flows into the inflow pipe 19*a* for a sewage treatment plant and the like, thus providing an effect of cleaning inside a pipe by way of rainwater.

In the separated sewage system according to the present embodiment, even under a heavy rainfall or a downpour, for example, the second water branching device 13 sequentially passes rainwater separated by the first water branching device 12 through the first regulating tank 2A, the first orifice 24A, the second regulating tank 2B, the second orifice 24B, the third regulating tank 2C and the third orifice 24C. This makes it possible to accurately separate and discharge rainwater with the target maximum rainwater volume $Q_m - Q_{orsn}$ ($=Q_{rdn}$) in each drainage area, which rainwater can be discharged into the public water body W. This reliably prevents, for example, possible flooding of the public water body W and makes it possible to store only the excess rainwater volume $Q_{\Delta m}$ in the regulating reservoir 4, thereby reducing a capacity requirement of a regulating reservoir.

In the separated sewage system according to the present embodiment, as in Embodiment 1, the first water branching device 12 and the second water branching device 13 include the first to third overflow weirs 22A, 22B, 22C provided on both sides of the channel 20. An overall length of the weirs increases to stabilize a hydraulic phenomenon and it is made possible to downsize the housing 26.

Embodiment 3

Figure 8:
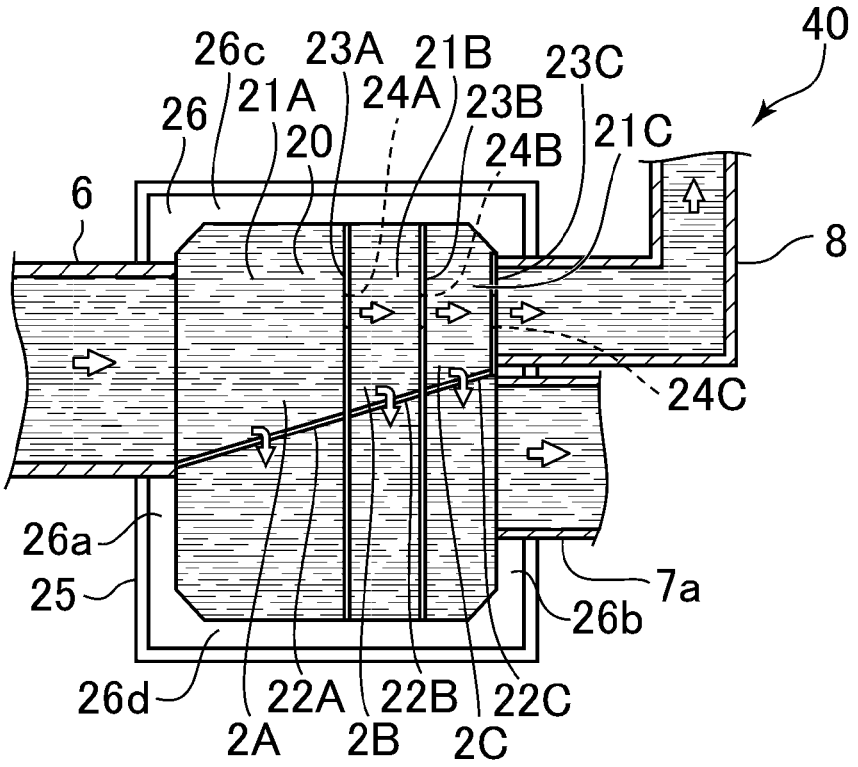
FIG. 8 is a partial cross-sectional plan view illustrating a configuration of a first water branching device included in a sewage system according to Embodiment 3 of the disclosure.

A sewage system according to Embodiment 3 is described below with reference to FIG. 8. In Embodiment 3, the same sign is given to the same component as that of the sewage system according to Embodiment 1 and a description thereof is omitted, and differences from Embodiment 1 are discussed. A first water branching device 40 according to Embodiment 3 includes the first to third overflow weirs 22A, 22B, 22C on one side of the channel 20. In Embodiment 3, sewage overflowing the first to third overflow weirs 22A, 22B, 22C flows down from one side of the channel 20. The second water branching device 3 of Embodiment 1, the first water branching device 12 and the second water branching device 13 of Embodiment 2 may also have the same configuration as that of the first water branching device 40.

Embodiment 4

Figure 9:
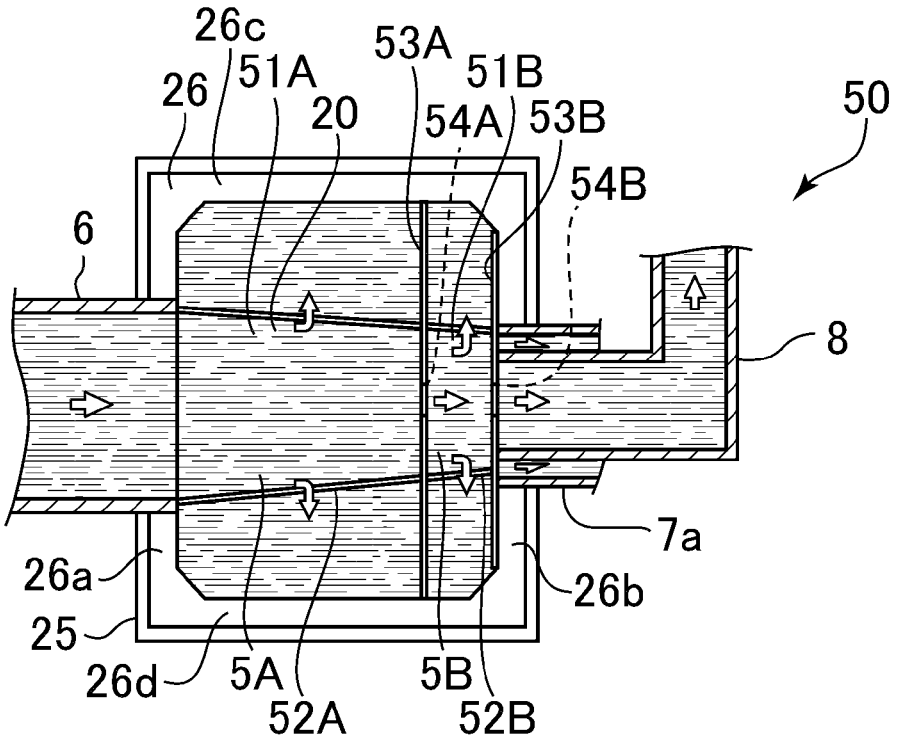
FIG. 9 is a partial cross-sectional plan view illustrating a configuration of a first water branching device included in a sewage system according to Embodiment 4 of the disclosure.

A sewage system according to Embodiment 4 is described below with reference to FIG. 9. In Embodiment 4, the same sign is given to the same component as that of the sewage system according to Embodiment 1 and a description thereof is omitted, and differences from Embodiment 1 are discussed. A first water branching device 50 according to Embodiment 4 includes two regulating tanks, that is, a first regulating tank 5A and a second regulating tank 5B, and a first bottom 51A, a second bottom 51B, a pair of first overflow weirs 52A, a pair of second overflow weirs 52B, a first partition 53A, a second partition 53B, a first orifice 54A, and a second orifice 54B. Providing two regulating tanks downsizes the housing 26. The second water branching device 3 of Embodiment 1, the first water branching device 12 and the second water branching device 13 of Embodiment 2 may also have the same configuration as that of the first water branching device 50.

Embodiment 5

Figure 10:
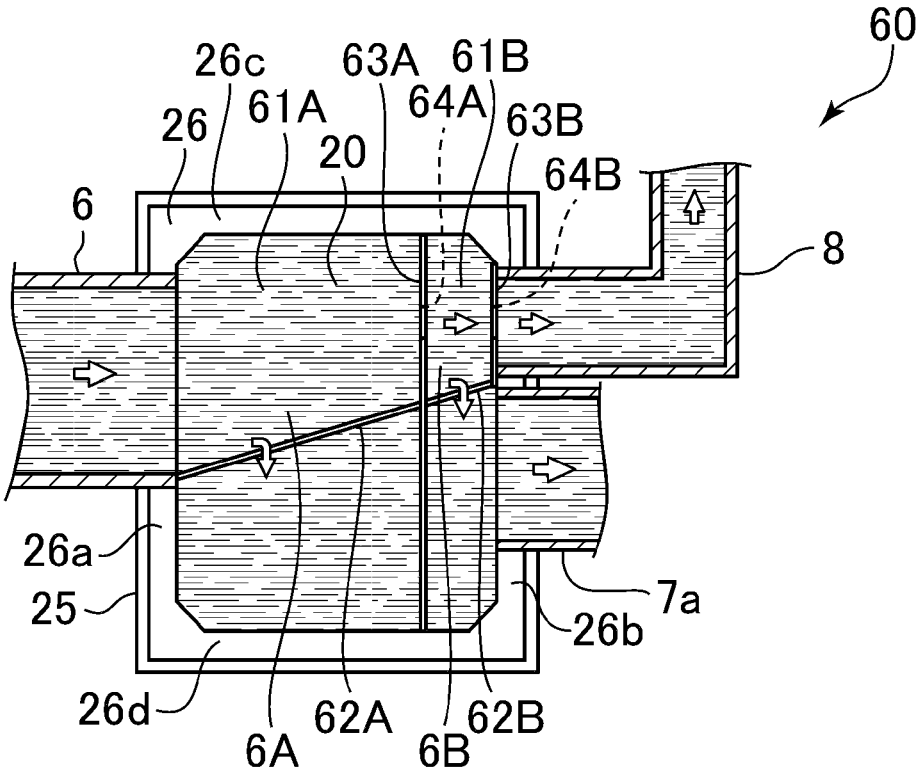
FIG. 10 is partial cross-sectional plan view illustrating a configuration of a first water branching device included in a sewage system according to Embodiment 5 of the disclosure.

A sewage system according to Embodiment 5 is described below with reference to FIG. 10. In Embodiment 5, the same sign is given to the same component as that of the sewage system according to Embodiment 1 and a description thereof is omitted, and differences from Embodiment 1 are discussed. A first water branching device 60 according to Embodiment 5 includes a first overflow weir 62A and a second overflow weir 62B provided on one side of the channel 20, and two regulating tanks, that is, a first regulating tank 6A and a second regulating tank 6B. The first water branching device 60 includes a first bottom 61A, a second bottom 61B, a first partition 63A, a second partition 63B, a first orifice 64A, and a second orifice 64B. The second water branching device 3 of Embodiment 1, the first water branching device 12 and the second water branching device 13 of Embodiment 2 may also have the same configuration as that of the first water branching device 60.

At least the following configurations are described in Embodiments 1 to 5:

(1) A sewage system including:

a first water branching device to which are connected a confluence pipe that introduces sewage, an intercepting pipe that drains sewage into a sewage treatment plant and a first discharge pipe, the first water branching device separating sewage coming from the confluence pipe into sewage to be drained into the intercepting pipe and sewage to be drained into the first discharge pipe; and a second water branching device to which are connected the first discharge pipe, a second discharge pipe that discharges sewage into a public water body and an inflow pipe for a regulating reservoir, the inflow pipe being connected to a regulating reservoir that stores sewage, the second water branching device separating sewage coming from the first discharge pipe into sewage to be drained into the second discharge pipe and sewage to be drained into the inflow pipe for a regulating reservoir, wherein the second water branching device includes a channel in which sewage coming from the first discharge pipe is drained into the second discharge pipe, a plurality of overflow weirs erected on at least one of both sides of the channel, a plurality of partitions each provided between each of the plurality of overflow weirs and between one of the overflow weirs and the second discharge pipe, the plurality of partitions each including an orifice formed therein, and a plurality of regulating tanks demarcated by the plurality of overflow weirs and the plurality of partitions, and the inflow pipe for a regulating reservoir introducing sewage overflowing the plurality of overflow weirs is connected below the plurality of regulating tanks.

(2) The sewage system according to (1), wherein the first water branching device includes a channel in which sewage coming from the confluence pipe is drained into the intercepting pipe, a plurality of overflow weirs erected on at least one of both sides of the channel, a plurality of partitions each provided between each of the plurality of overflow weirs and between one of the overflow weirs and the intercepting pipe, the plurality of partitions each including an orifice formed therein, and a plurality of regulating tanks demarcated by the plurality of overflow weirs and the plurality of partitions, and the first discharge pipe introducing sewage overflowing the plurality of overflow weirs is connected below the plurality of regulating tanks.

(3) The sewage system according to (1) or (2), wherein the plurality of overflow weirs of the second water branching device is erected on both sides of a channel in which sewage coming from the first discharge pipe flows into the second discharge pipe.

(4) The sewage system according to any one of (1) to (3), wherein a regulating tank arranged most upstream among the plurality of regulating tanks of the second water branching device is longest in a channel direction.

(5) The sewage system according to any one of (1) to (4), wherein a partition provided between each of the plurality of overflow weirs of the second water branching device is constructed in a housing of the second water branching device.

(6) The sewage system according to any one of (1) to (5), wherein the second water branching device includes the three regulating tanks.

(7) The sewage system according to any one of (1) to (6), wherein the orifice in the second water branching device is entirely lower than a water surface of sewage downstream.

(8) The sewage system according to (2), wherein the plurality of overflow weirs of the first water branching device is erected on both sides of a channel in which sewage coming from the confluence pipe flows into the intercepting pipe.

(9) A sewage system according to (2) or (8), wherein the first water branching device includes the three regulating tanks.

(10) A sewage system including:

a first water branching device to which are connected a rainwater pipe that introduces rainwater, an intercepting pipe that drains rainwater into a sewage treatment plant into which wastewater is drained from a wastewater pipe and a first discharge pipe, the first water branching device separating rainwater coming from the rainwater pipe into rainwater to be drained into the intercepting pipe and rainwater to be drained into the first discharge pipe; and a second water branching device to which are connected the first discharge pipe, a second discharge pipe that discharges rainwater into a public water body and an inflow pipe for a regulating reservoir, the inflow pipe being connected to a regulating reservoir that stores rainwater, the second water branching device separating rainwater coming from the first discharge pipe into rainwater to be drained into the second discharge pipe and rainwater to be drained into the inflow pipe for a regulating reservoir, wherein the first water branching device includes a channel in which rainwater coming from the rainwater pipe is drained into the intercepting pipe, a plurality of overflow weirs erected on at least one of both sides of the channel, a plurality of partitions each provided between each of the plurality of overflow weirs and between one of the overflow weirs and the intercepting pipe, the plurality of partitions each including an orifice formed therein, and a plurality of regulating tanks demarcated by the plurality of overflow weirs and the plurality of partitions, wherein the first discharge pipe introducing rainwater overflowing the plurality of overflow weirs is connected below the plurality of regulating tanks, and the second water branching device includes a channel in which rainwater coming from the first discharge pipe is drained into the second discharge pipe, a plurality of overflow weirs erected on at least one of both sides of the channel, a plurality of partitions each provided between each of the plurality of overflow weirs and between one of the overflow weirs and the second discharge pipe, the plurality of partitions each including an orifice formed therein, and a plurality of regulating tanks demarcated by the plurality of overflow weirs and the plurality of partitions, wherein the inflow pipe for a regulating reservoir introducing rainwater overflowing the plurality of overflow weirs is connected below the plurality of regulating tanks.

(11) The sewage system according to (10), wherein the plurality of overflow weirs of the first water branching device is erected on both sides of a channel in which rainwater coming from the rainwater pipe flows into the intercepting pipe, and the plurality of overflow weirs of the second water branching device is erected on both sides of a channel in which rainwater coming from the first discharge pipe flows into the second discharge pipe.

(12) The sewage system according to (10) or (11), wherein a regulating tank arranged most upstream among the plurality of regulating tanks of the first water branching device is longest in a channel direction and a regulating tank arranged most upstream among the plurality of regulating tanks of the second water branching device is longest in a channel direction.

(13) The sewage system according to any one of (10) to (12), wherein a partition provided between each of the plurality of overflow weirs of the first water branching device is constructed in a housing of the first water branching device, and a partition provided between each of the plurality of overflow weirs of the second water branching device is constructed in a housing of the second water branching device.

(14) The sewage system according to any one of (10) to (13), wherein the first water branching device and the second water branching device each include the three regulating tanks.

(15) The rainwater system according to any one of (10) to (14), wherein the orifice in the first water branching device and the orifice in the second water branching device each are entirely lower than a water surface of rainwater downstream.

(16) The sewage system according to any one of (10) to (15), wherein a pre-planned interception volume of rainwater that is separated by the first water branching device and is to be drained into the intercepting pipe is set based on nonpoint load countermeasures.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

While the foregoing embodiments have discussed a sewage system in the first to n-th drainage areas as an example, the disclosure is also applicable to a sewage system in a single region, district or facility or the like.

While Embodiment 1 has discussed a case in which the first water branching device 2 capable of accurately controlling water separation is used, it is also possible to reduce a capacity requirement of a regulating reservoir by using the second water branching device 3 even when a conventional water branching device is used as a first water branching device.

While the foregoing embodiments have discussed a case in which only the second water branching devices 3, 13 each include the inclined path 28, a first water branching device may include an inclined path depending on design conditions, or a second water branching device may not include an inclined path. A shape and a size of the first to third bottoms 21A, 21B, 21C, a shape, a size and a height of the first to third overflow weirs 22A, 22B, 22C, a shape and a size of the first to third orifices 24A, 24B, 24C, a shape, a size and an arrangement location of each connected pipe, and the like, may undergo a design change as appropriate depending on design conditions for the first water branching device and the second water branching device.

While the foregoing embodiments have discussed a case in which the first partition 23A and the second partition 23B are constructed between the side wall 26*c* and the side wall 26*d*, the partitions need not necessarily be constructed.

While the foregoing embodiments have discussed a case in which a submerged orifice is used that is arranged entirely lower than a water surface downstream, using an orifice that is partially lower than a water surface downstream obtains the effects of the disclosure.

While the foregoing embodiments have discussed a case of a water branching device including two or three regulating tanks, a water branching device may have four or more regulating tanks. Including four or more regulating tanks provides more accurate water separation control.

While the foregoing embodiments have discussed the pre-planned interception volume $Q_{osn}$, a sewage volume to undergo a higher treatment or a simple treatment in the sewage treatment plant 5, a sewage volume to be discharged from the sewage treatment plant 5, a sewage volume or a rainwater volume to be drained from the regulating reservoir 4 into the sewage treatment plant 5, the pre-planned interception volume $Q_{orsn}$ of nonpoint load countermeasures and the pre-planned wastewater volume $Q_{sn}$, and the like, using setting examples, such setting examples are not limitative and, for example, setting may be changed as appropriate depending on an environment of each region, district or the like.

The regulating reservoir 4 described in the foregoing embodiments may be a facility constructed as a permanent facility or a temporarily constructed facility. A structure or a system of the regulating reservoir 4 is not limitative as long as the regulating reservoir 4 is a facility that temporarily stores and regulates sewage or rainwater. For example, the regulating reservoir 4 may be an artificial lake, or a facility using a park, an athletic field, a parking lot, or the like.

While the foregoing embodiments has discussed a case in which the regulating reservoir 4 is provided with a water gauge, a configuration is possible in which a densitometer for measuring a density of pollutant substances is provided, and when a predetermined density is reached, sewage or rainwater stored in the regulating reservoir 4 is drained into the sewage treatment plant 5.

This application claims the benefit of Japanese Patent Application No. 2019-101834 filed on May 30, 2019, the entire disclosure of which is incorporated by reference herein.

REFERENCE SIGNS LIST

1 Combined sewage system
10 Separated sewage system
2, 12, 40, 50, 60 First water branching device
3, 13 Second water branching device
4 Regulating reservoir
5 Sewage treatment plant
6 Confluence pipe
7*a*, 17*a* First discharge pipe
7*b*, 17*b* Second discharge pipe
8, 18 Intercepting pipe
8*a*, 19*a* Inflow pipe for a sewage treatment plant
8*b* Discharge pipe for a sewage treatment plant
9*a* Inflow pipe for a regulating reservoir
9*b* Outflow pipe for a regulating reservoir
9*c* Discharge pipe for a regulating reservoir
11 Rainwater pipe
19 Wastewater pipe
20 Channel
2A First regulating tank
2B Second regulating tank
2C Third regulating tank
15 21A First bottom
21B Second bottom
21C Third bottom
22A First overflow weir
22B Second overflow weir
22C Third overflow weir
23A First partition
23B Second partition
23C Third partition
24A First orifice
24B Second orifice
24C Third orifice
26 Housing
28 Inclined path
W Public water body

The invention claimed is:

1. A sewage system comprising:

a first water branching device to which are connected a confluence pipe that introduces sewage, an intercepting pipe that drains sewage into a sewage treatment plant and a first discharge pipe, the first water branching device separating sewage coming from the confluence pipe into sewage to be drained into the intercepting pipe and sewage to be drained into the first discharge pipe; and a second water branching device to which are connected the first discharge pipe, a second discharge pipe that discharges sewage into a public water body and an inflow pipe for a regulating reservoir, the inflow pipe being connected to the regulating reservoir that stores sewage, the second water branching device separating sewage coming from the first discharge pipe into sewage to be drained into the second discharge pipe and sewage to be drained into the inflow pipe for the regulating reservoir, wherein the second water branching device includes a channel in which sewage coming from the first discharge pipe is drained into the second discharge pipe, a plurality of overflow weirs erected on at least one of both sides of the channel, a plurality of partitions each provided between each of the plurality of overflow weirs and between the overflow weir arranged downstream and the second discharge pipe, the plurality of partitions each including an orifice formed therein, and a plurality of regulating tanks demarcated by the plurality of overflow weirs and the plurality of partitions, and the inflow pipe for a regulating reservoir introducing sewage overflowing the plurality of overflow weirs is connected below the plurality of regulating tanks.

2. The sewage system according to claim 1, wherein the first water branching device includes a channel in which sewage coming from the confluence pipe is drained into the intercepting pipe, a plurality of overflow weirs erected on at least one of both sides of the channel, a plurality of partitions each provided between each of the plurality of overflow weirs and between the overflow weir arranged downstream and the intercepting pipe, the plurality of partitions each including an orifice formed therein, and a plurality of regulating tanks demarcated by the plurality of overflow weirs and the plurality of partitions, and the first discharge pipe introducing sewage overflowing the plurality of overflow weirs is connected below the plurality of regulating tanks.

3. The sewage system according to claim 1, wherein the plurality of overflow weirs of the second water branching device is erected on both sides of the channel in which sewage coming from the first discharge pipe flows into the second discharge pipe.

4. The sewage system according to claim 1, wherein the regulating tank arranged most upstream among the plurality of regulating tanks of the second water branching device is longest in a channel direction.

5. The sewage system according to claim 1, wherein at least one of the partitions provided between each of the plurality of overflow weirs of the second water branching device is constructed in a housing of the second water branching device.

6. The sewage system according to claim 1, wherein the number of the regulating tanks which the second water branching device includes is three.

7. The sewage system according to claim 1, wherein the orifices in the second water branching device are entirely lower than a water surface of sewage downstream.

8. The sewage system according to claim 2, wherein the plurality of overflow weirs of the first water branching device is erected on both sides of the channel in which sewage coming from the confluence pipe flows into the intercepting pipe.

9. The sewage system according to claim 2, wherein the number of the regulating tanks which the first water branching device includes is three.

10. A sewage system comprising:

a first water branching device to which are connected a rainwater pipe that introduces rainwater, an intercepting pipe that drains rainwater into a sewage treatment plant into which wastewater is drained from a wastewater pipe and a first discharge pipe, the first water branching device separating rainwater coming from the rainwater pipe into rainwater to be drained into the intercepting pipe and rainwater to be drained into the first discharge pipe; and a second water branching device to which are connected the first discharge pipe, a second discharge pipe that discharges rainwater into a public water body and an inflow pipe for a regulating reservoir, the inflow pipe being connected to the regulating reservoir that stores rainwater, the second water branching device separating rainwater coming from the first discharge pipe into rainwater to be drained into the second discharge pipe and rainwater to be drained into the inflow pipe for the regulating reservoir, wherein the first water branching device includes a channel in which rainwater coming from the rainwater pipe is drained into the intercepting pipe, a plurality of overflow weirs erected on at least one of both sides of the channel, a plurality of partitions each provided between each of the plurality of overflow weirs and between the overflow weir arranged downstream and the intercepting pipe, the plurality of partitions each including an orifice formed therein, and a plurality of regulating tanks demarcated by the plurality of overflow weirs and the plurality of partitions, wherein the first discharge pipe introducing rainwater overflowing the plurality of overflow weirs is connected below the plurality of regulating tanks, and the second water branching device includes a channel in which rainwater coming from the first discharge pipe is drained into the second discharge pipe, a plurality of overflow weirs erected on at least one of both sides of the channel, a plurality of partitions each provided between each of the plurality of overflow weirs and between the overflow weir arranged downstream and the second discharge pipe, the plurality of partitions each including an orifice formed therein, and a plurality of regulating tanks demarcated by the plurality of overflow weirs and the plurality of partitions, wherein the inflow pipe for the regulating reservoir introducing rainwater overflowing the plurality of overflow weirs is connected below the plurality of regulating tanks.

11. The sewage system according to claim 10, wherein the plurality of overflow weirs of the first water branching device is erected on both sides of the channel in which rainwater coming from the rainwater pipe flows into the intercepting pipe, and the plurality of overflow weirs of the second water branching device is erected on both sides of the channel in which rainwater coming from the first discharge pipe flows into the second discharge pipe.

12. The sewage system according to claim 10, wherein the regulating tank arranged most upstream among the plurality of regulating tanks of the first water branching device is longest in a channel direction and the regulating tank arranged most upstream among the plurality of regulating tanks of the second water branching device is longest in a channel direction.

13. The sewage system according to claim 10, wherein at least one of the partitions provided between each of the plurality of overflow weirs of the first water branching device is constructed in a housing of the first water branching device, and at least one of the partitions provided between each of the plurality of overflow weirs of the second water branching device is constructed in a housing of the second water branching device.

14. The sewage system according to claim 10, wherein the number of the regulating tanks which the first water branching device and the second water branching device each include is three.

15. The sewage system according to claim 10, wherein the orifices in the first water branching device and the orifices in the second water branching device each are entirely lower than a water surface of rainwater downstream.

16. The sewage system according to claim 10, wherein a pre-planned interception volume of rainwater that is separated by the first water branching device and is to be drained into the intercepting pipe is set based on nonpoint load countermeasures.

* * * * *